US005806565A

United States Patent [19]

Kadlicko

[11] Patent Number: 5,806,565

[45] Date of Patent: Sep. 15, 1998

[54] HYDRAULIC VALVES

[75] Inventor: George Kadlicko, Mississauga, Canada

[73] Assignee: Microhydraulics Inc., Ontario, Canada

[21] Appl. No.: 566,058

[22] Filed: Dec. 1, 1995

Related U.S. Application Data

[63] Continuation-in-part of Ser. No. 509,838, Aug. 1, 1995, abandoned which is a continuation-in-part of PCT/CA95/00057, Feb. 6, 1995.

[30] Foreign Application Priority Data

| | | | |
|---|---|---|---|
| Feb. 4, 1994 | [GB] | United Kingdom | 9402142 |
| Feb. 4, 1994 | [GB] | United Kingdom | 9402146 |
| Feb. 4, 1994 | [GB] | United Kingdom | 9402147 |
| Dec. 13, 1994 | [GB] | United Kingdom | 9425092 |
| Dec. 13, 1994 | [GB] | United Kingdom | 9425144 |

[51] Int. Cl.[6] ..... F15B 13/043

[52] U.S. Cl. ..... 137/625.63; 137/625.64

[58] Field of Search ..... 137/625.63, 625.64

[56] References Cited

U.S. PATENT DOCUMENTS

| | | | |
|---|---|---|---|
| 2,920,650 | 1/1960 | Moog | 137/625.69 |
| 4,061,155 | 12/1977 | Sopha | 137/625.62 X |
| 4,526,201 | 7/1985 | Geylar et al. | 137/625.63 |
| 4,970,941 | 11/1990 | Reinhardt | 137/625.64 X |

*Primary Examiner*—Gerald A. Michalsky
*Attorney, Agent, or Firm*—Ladas & Parry

[57] ABSTRACT

A hydraulic valve includes a spool movable within a body to regulate flow across the valve. Movement of the spool is controlled by an electromagnetic actuator that operates either directly or through a pilot stage upon the spool. When operating through a pilot stage, the actuator varies pilot pressure by an operating member co-operating with an orifice. A flapper valve may be used to vary a pair of pilot flows in complementary manner. Feedback signals of pressure and spool position are provided to a controller which selectively combines the signals to monitor the operating parameters of the valve. The controller may modify the position signal with the pressure signal to obtain an indication of flow rate through the valve.

24 Claims, 18 Drawing Sheets

HYDRAULIC VALVES

This application is a continuation-in-part of U.S. patent application Ser. No. 08/509,838, filed Aug. 1, 1995, now abandoned, which is a continuation-in-part of PCT application PCT/CA95/00057, filed Feb. 6, 1995.

The present invention relates to hydraulic valves and hydraulic circuits incorporating such valves.

Hydraulic circuits have been utilized for many years to deliver power from prime movers. Such circuits have the inherent advantage that they can deliver a high power density between remote locations and yet offer precise control by regulating the flow rate, pressure or direction of fluid flow in the circuit to achieve the desired effect.

Presently, each of these parameters is controlled by separate elements (for example, a flow controller or pressure regulator) that are incorporated into a circuit to perform their separate functions. Although each function is considered separately, the requirements of the different components are often in conflict with one another because of the fundamental differences of the parameters being controlled.

For example, flow control is normally performed by setting an orifice within a valve which is essentially a position sensitive element. On the other hand, pressure is related to the forces encountered by components of the circuit. If a valve is set to deliver a certain flow rate, hydraulic fluid will flow through the valve but the pressure at which the fluid is delivered depends upon the downstream conditions. To that extent, therefore, the two parameters are unrelated. On the other hand, a change of one parameter may affect the other. For example, where the load imposed is greater than the force that can be supplied by the system, the flow rate is zero even though the valve is set to deliver a certain flow rate.

It has therefore been proposed to compensate hydraulic components, for example by varying orifices as system pressures change to maintain a fixed flow rate but again this has been undertaken on a component by component basis so that an overall control function is built up from the individual system components.

The availability of robust electronic control has resulted in an attempt to utilize electronics in conjunction with hydraulic components to improve the control of hydraulic circuits. However, in general, this approach has resulted in the substitution of existing individual mechanical or hydraulic controls with individual electronic controls and no attempt has been made to integrate the overall control of a complete system. Accordingly, the previous conflicts between system components remain. This approach also results in undue complexity and multiplicity of components in a circuit where it is subject to widely changing operating conditions such as reversibility of flow. Under one set of flow conditions, a particular set of components is needed to perform the requisite control function but as the condition change, those components may be redundant or even hinder the operation of the circuit. Accordingly, plural control circuits may be needed, one for each operating condition, so that the number of components increases. Each component will also have associated with it the inherent losses due to internal leakage, pilot flows and electrical power consumption so that the overall energy efficiency of the circuit decreases.

There is therefore a need for a versatile hydraulic valve that may selectively control the pressure, flow rate or direction of fluid in a hydraulic circuit to provide different control functions at different times.

Preferably, such a valve should be capable of handling a variety of flow rates and pressures in various configurations while meeting industry standards for size and installation.

It is therefore an object of the present invention to provide a valve that meets at least some of the above requirements.

In general terms, therefore, the present invention provides a valve with a body and a valve member movable within the body to control flow between ports of the valve. Movement of the spool is controlled by an actuator receiving electrical control signals from a controller to modulate the position of the spool. A position sensor monitors the position of the spool to provide a position feedback to the controller. The valve further includes at least one pressure transducer associated with one of the ports and providing a feedback signal to the controller. By selectively combining the feedback signals with a set signal indicating a desired condition, the actuator may modulate the spool to maintain the desired condition as circuit parameters vary.

In one preferred embodiment, the actuator includes a pilot stage wherein pilot pressure acting upon the spool are modulated by varying electrical current to a coil. The modulation of the pressures may be obtained by co-operation between an orifice and an operating member to vary the orifice size and hence pressure drop across the orifice.

Where a pilot stage is utilized, a particularly beneficial arrangement utilizes a flapper valve in which a torque motor adjusts an armature to vary the flow through a pair of pilot orifices in a complementary manner.

In one arrangement of flapper valve, the armature is arranged so that pairs of opposite poles are provided at spaced locations along the armature such that the couple applied to the armature is enhanced.

In another arrangement of flapper valve, the armature is used as a valve member to modulate pilot flow and thereby establish a pressure differential across the spool.

To avoid excessive flow forces acting upon the spool, flow between the ports may be controlled by a secondary valve member whose position is controlled by a primary valve member controlled by the actuator. The secondary valve member follows movement of the primary valve member so that adjustment and flow forces are maintained minimal even at high flow rates.

When used as a pressure compensated flow controlling valve, the differential pressure across the valve is monitored and modifies the feedback signal from the position sensor that is primarily indicative of orifice size established in the valve. Thus, at high pressure differentials, the orifice size is reduced to maintain a predetermined flow rate indicated by the set signal. changes in pressure differential caused by changing circuit conditions will thus be compensated.

Where a set pressure is to be maintained at a port, the pressure feedback signal is used to modulate the valve member with the position sensor being disabled or used as a maximum flow rate limit if preferred.

The valve is thus able to function in several different ways by simply adjusting the combination of feedback signals which may be accomplished by simply selecting one of a number of available control functions. the valve is therefore able to fulfil multiple functions as required without additional or redundant components being utilized.

Embodiments of the invention will now be described by way of example only with reference to the accompanying drawings in which FIG. 1 is a section through a first embodiment of valve;

Figure 1:
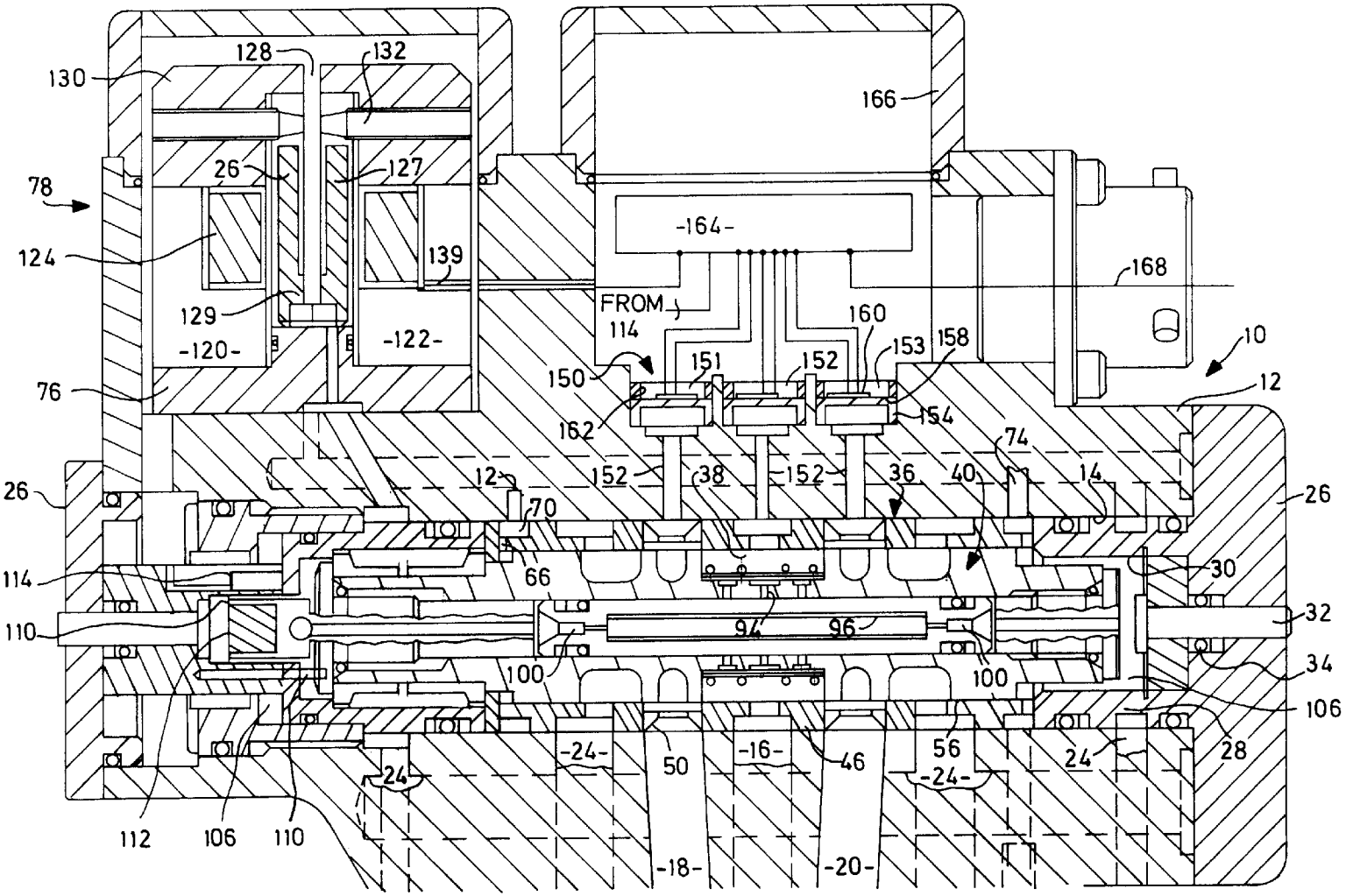

Referring therefore to FIG. 1, a hydraulic valve generally indicated at 10 includes a valve body 12 with a central bore 14. In this embodiment, the valve 10 is designed to be incorporated into a block of similar valves so that a number of valves may be ganged together on a common surface and receive fluid from and deliver fluid to a manifold located within the surface. This configuration of valve is generically known as a C-type block valve.

In the embodiment shown in FIG. 1, pressure fluid is supplied to the bore 14 through a pressure delivery duct 16 and is directed to a consumer such as an actuator through a pair of delivery passages 18, 20 that extend from the bore 14 to the undersurface 22 of the block 12. The delivery passages 18, 20 are spaced on standard centers to mate up with corresponding ducts in the mounting structure. Provision is also made within the block 12 for a return duct 24 that is connected between the bore 14 and a sump (not shown). It will be appreciated that the passages 16, 24 may be displaced circumferentially from the section line and may be positioned to allow communication directly with adjacent abutting blocks of similar configuration.

End caps 26 are located across opposite ends of the bore 14 and a cylindrical plug 28 formed integrally with one of the and caps 26. The plug 28 is counterbored as indicated at 30 and carries a plunger 32 sealed within the end cap 26 by O-rings 34.

Figure 2:
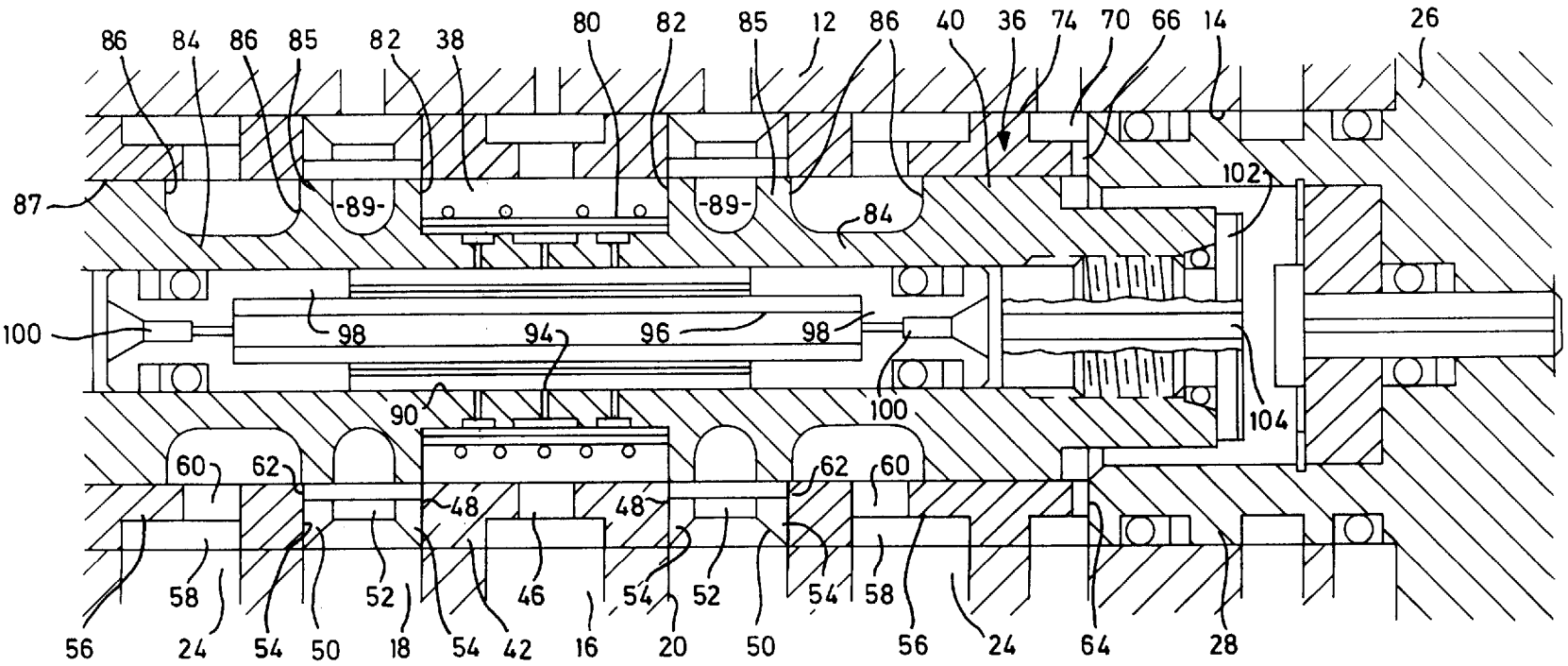
FIG. 2 is an enlarged view of a portion of the valve shown in FIG. 1.

The bore 14 carries a segmented annular sleeve, generically indicated at 36, which defines a cylindrical valve chamber 38 in which a spool 40 may slide. As best seen in FIG. 2, the sleeve 36 is formed from a set of annular rings which have radial flow passages formed to allow communication between the valve chamber 38 and bore 14. Each of the rings is formed from a sintered carbide material and is configured to permit accurate fitting relative to the spool 40.

Thus as best seen in FIG. 2, the sleeve 36 includes a central ring 42, a pair of supply rings 50 on either side of central ring 42, and a pair of end rings 56 outboard of the supply rings 50. The central ring 42 has a radial passageway 46 to allow fluid to flow from the duct 16 into the chamber 38 and a pair of radial flanks 48 at opposite ends which abut respective ones of the pair of supply rings 50.

The supply rings 50 are aligned with the respective delivery passages 18, 20 and have radial passages 52 that allow fluid to flow from within the chamber 38 to the delivery passages 18, 20. Each of the rings 50 has a pair of radial flanks 54, one of which abuts the radial flank 48 and the other of which abuts an end ring 36.

Each of the end rings 56 has a circumferential recess 58 that is aligned with the tank duct 24 and has a radial passage 60 to allow flow from the chamber 38 to the tank duct 24. The end ring 56 has an inwardly directed radial face 62 which abuts against the outwardly directed radial face 54 of ring 50 and in turn has an outwardly directed radial face 64 carrying radial slots 66 (FIGS. 1 and 2). The slots 66 extend between the chamber 38 and a circumferential recess 70 which is aligned with respective ones of pilot lines 72, 74. The pilot lines 72, 74 are directed by internal passageways to the base 76 of a pilot pressure stage 78, the details of which will be described below. One of the radial faces 64 abuts the cylindrical plug 28 to locate the segmented sleeve 36 axially within the bore 20.

The spool 40 is formed with a set of circumferential grooves defining axially spaced lands. Thus a central groove 80 has radial flanks 82 whose axial spacing corresponds to the spacing between the flanks 48 of the central ring 42. A circumferential groove 84 is located opposite the tank duct 24 and has radial flanks 86. The spacing between the adjacent radial flanks 82 and 86 corresponds with the spacing of the flanks 54 of the ring 50 to define a land 85 that extends across respective ones of the delivery ports 18, 20. Similarly, land 87 is located axially outward of the flanks 86. A circumferential groove 89 is formed in the land 85 to reduce the surface area in contact with the sleeve 40.

Before describing the particulars of the spool 40, it should be noted that the construction of the sleeve 36 and spool 40 provide an economical efficient method of manufacturing the valve. The body 12 may be manufactured from mild steel with the expose surfaces, including the bore 14, nickel-plated to provide corrosion resistance and a requisite surface hardness. The rings 42, 50, 56 making up the segmented sleeve 36 may be may of sintered carbide which is very hard and therefore offers exceptional wear resistance. The provision of the radial flanks on the rings permits accurate manufacture and dimensioning of the rings to maintain close tolerances between the outwardly directed flanks 54 of the supply rings 50 when the rings 42 and 50 are assembled. Similarly, the provision of the radial flanks 82, 86 allows the spool to be manufactured with simple external grinding techniques and permits accurate spacing between the radial flanks 82, 86 to match with the axial spacing of the respective rings 42, 50. The spool 40 may be plated with a surface finish such as titanium nitrite to provide a very hard surface which reduces wear between the hardened surface of the sintered carbide rings and the spool. The nickel plating of the mild steel body provides a surface hardness that allows the rings 42, 50, 56 to be assembled as a press fit within the bore 14 to further simplify manufacture.

Returning therefore to the arrangement of the spool 40, a central passage 90 extends axially along the spool 40 and is connected by radial passages 94 to the groove 80. A cylindrical filter cartridge 96 is supported in the passage 90 by a pair of orifice plates 98 that have constricted orifices 100 to control flow from the groove 80 to the control ducts 72, 74 respectively.

The orifice plates 98 are located within the passage 90 by a pair of plugs 102 each of which has an axial passage 104 to permit flow from the filter 96 through the orifice 100.

End chambers 106 are defined between the spool 40 and respective end caps 26 and communicate with the control ducts 72, 74. The pressure in the control ducts 72, 74 is thus acting upon opposite ends of the spool 40 with movement of the spool 40 being opposed by a spring assembly 108 that maintains the spool 40 centered in the absence of a pressure differential. An extension 110 is formed on one of the plugs 102 and carries a magnetic insert 112. The end cap 26 associated with the extension 110 carries a Hall effect sensor 114 which is aligned with the magnetic insert 112 and so provides a signal indicative of the position of the spool 40 relative to the sleeve 36. A pin 116 co-operates with the spool 40 and end cap 26 to inhibit relative rotation between the insert 112 and sensor 114 to provide a consistent signal.

Figure 3:
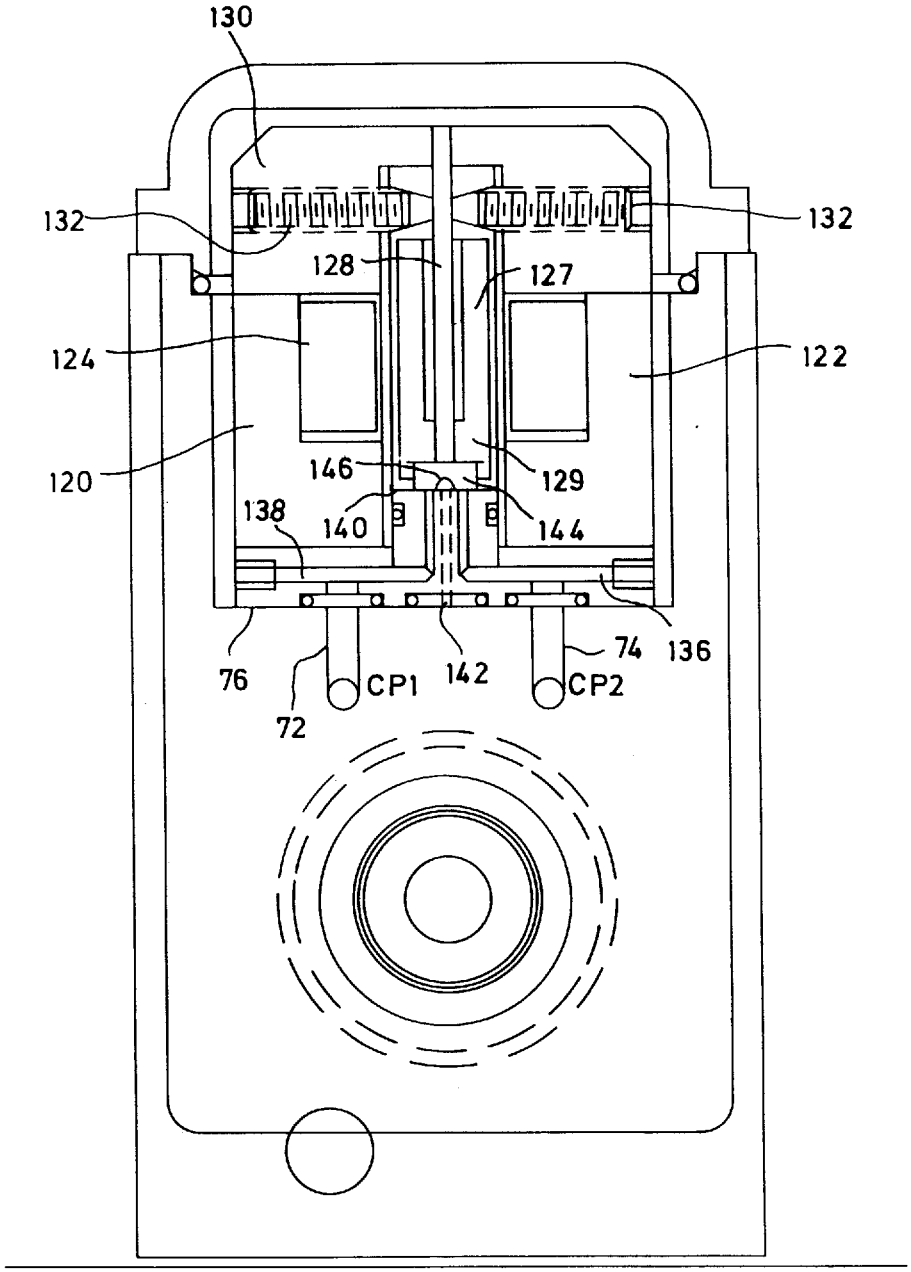
FIG. 3 is a view of an actuator used in a pilot stage of the valve shown in FIG. 1.

The relative pressure within the control ducts 72, 74 is determined by the actuator 78, shown in greater detail in FIG. 3. The actuator 78 includes a pair of semicircular magnetic pole pieces 120, 122 surrounding an electrical coil 124. An armature 126 comprises a sleeve 127 connected to a pin 128 secured to a housing 130. The armature 126 comprises a sleeve 127 connected to the pin 128 by a collar 129 adjacent its lower and. The pole pieces 120, 122 are arranged so that by varying the current to the coil 124, magnetic forces are induced between the pole pieces 120, 122 through the armature 26 to cause a bending moment on the pin 128. The pin 128 is centered by set screws 132 so that the lower end of the armature 126 moves in an arc over the base 76.

Figure 4:
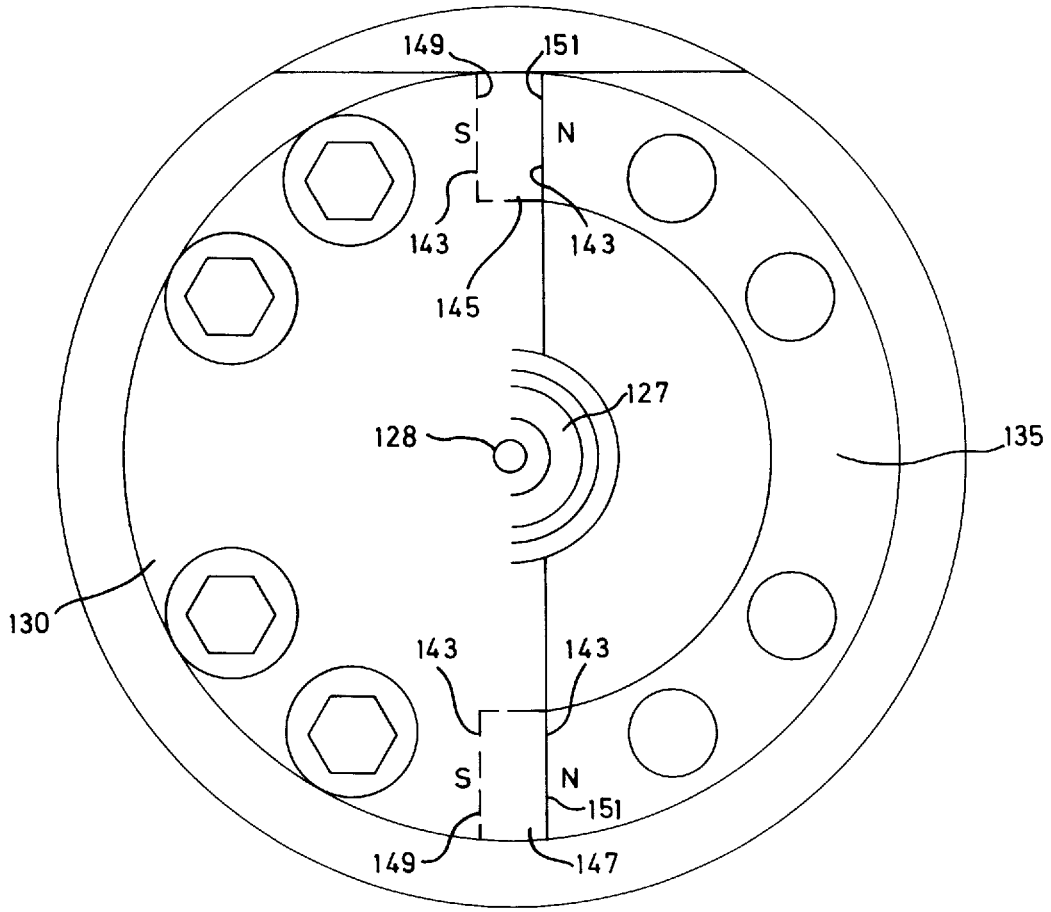
FIG. 4 is a plan view, partly in section, of the actuator shown in FIG. 3.
Figure 5:
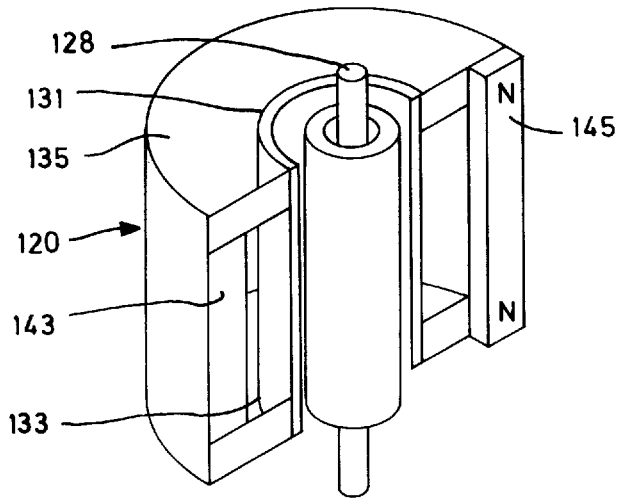
FIG. 5 is a sectional perspective view of the actuator shown in FIG. 4.

More particularly, as can be seen in FIGS. 4 and 5, the pair of pole pieces 120, 122 are supported on the bass 76 and encompass a tubular spacer 131. Each of the pole pieces 120, 122, as best shown in FIG. 5, is semi-cylindrical and has a recess 133 located between upper and lower flanges 135, 137. Coil 124 is located in the recesses 133 with leads 139 (FIG. 1) passing through a hole 141 (FIG. 1) for connection to a control circuit.

As seen in FIG. 4, the pole pieces 120, 122 have end faces 143 spaced from one another by a pair of permanent magnets 145, 147. The opposite poles of the magnets 145, 147 are arranged on the faces 149, 151 of the magnets 145, 147 that abut the faces 143 of the pole pieces 120, 122. The magnets 145, 147 are oriented so that like poles are in abutment with the faces 143 of the same pole piece so that the pole piece acquires the same polarity as the face of the magnet 145, 147 abutting it. Accordingly, referring again to FIG. 4, one of the pole pieces 120 provides north poles at axially spaced locations along the tubular spacer 131 and the other of the pole pieces 122 provides south poles at axially spaced locations along the spacer 131.

The flanges 135, 137 concentrate the magnetic flux at the axially spaced locations which, combined with the generally cylindrical nature of the flanges creates a relatively high flux density at opposite ends of the armature 126.

In operation, the supply of a current to the coil 124 will induce a magnetic field in the armature 126 to produce opposite poles at opposite ends whose polarity will depend upon the direction current flow. Assuming that the current flows to induce a north pole at the end adjacent to the base 76, it will be noted that the lower end of the armature 126 is repelled by the pole piece 120 and attracted by the pole piece 122. Conversely, at the end of the armature 126 adjacent to the housing 130, the armature 126 is attracted by the pole piece 120 and repelled by the pole piece 122. Accordingly, a couple is applied through the sleeve 127 and collar 129 to the pin 128 causing the free end of the armature 126 to deflect radially relative to the base 76. Modulation of the current to the coil 124 therefore adjusts the couple applied and the corresponding deflection. Reversal of the current will cause an opposite couple to be applied to the pin.

Figure 6:
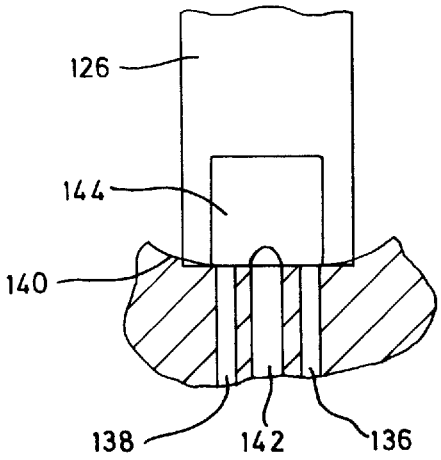
FIG. 6 is an enlarged sectional view of a portion of the actuator shown in FIG. 4.

As may be seen more clearly in FIGS. 3 and 6, the control ducts 72, 74 are directed through internal passages 134, 136 respectively to a 3 concave, part spherical end surface 140 of the base 76. A central drain passage 142 is provided between the supply passages 136, 138.

The end of armature 126 carries a cylindrical plug 144 with a central recess 146. The recess 146 is centered over the drain passage 142 and is dimensioned so as to seal the passages 136, 138 when the armature 126 is centered. Movement of the armature 126 from the neutral position causes the plug 144 to be displaced radially and for the recess 146 to bridge one of the supply passages 136 or 138 and allow fluid to flow from that supply passage 136, 138 to the drain 142. Accordingly, a differential pressure will be established between the supply duct 72, 74 to provide a differential hydraulic force across the spool 40. Adjustment of the current to the coil 124 as described above may thus be used to modulate the control pressures in the control ducts 72, 74 and hence in the end chambers 106 so that a differential pressure is applied to the spool 40. The differential pressure moves the spool 40 relative to the sleeve 36 against the bias of spring assembly 108 to establish flow across the valve 10.

As may be noted from FIG. 1, the body 12 also includes a pressure transducer assembly 150 including three pressure transducers 151, 152, 153. Each of the transducers is connected by respective internal ducts 155, 157, 159 to the passages 16, 18, 20 which is fed with fluid pressure at the passages 16, 18, 20 by means of respective internal ducts 152. Each of the pressure transducers 151, 152, 153 includes a diaphragm 154 having a central recess 156 and an end surface 158. A strain gauge 160 is mounted on the end surface 158 so as to be flexed as the pressure is the chamber 156 varies. Each of the diaphragms 154 in retained within the body 12 by means of a look nut 162. The output from the strain gauge 160 is applied to a circuit board 164 located within a cap 166 attached to the body 12. Circuit board 164 also regulates the power supplied to the coil 124 and receives signals from the position transducer 114. An external control signal 168 is also applied to the board 164 which is configured to implement the desired control strategy through modulation of the current supplied to the coil 124 based upon the signals received.

Figure 7:
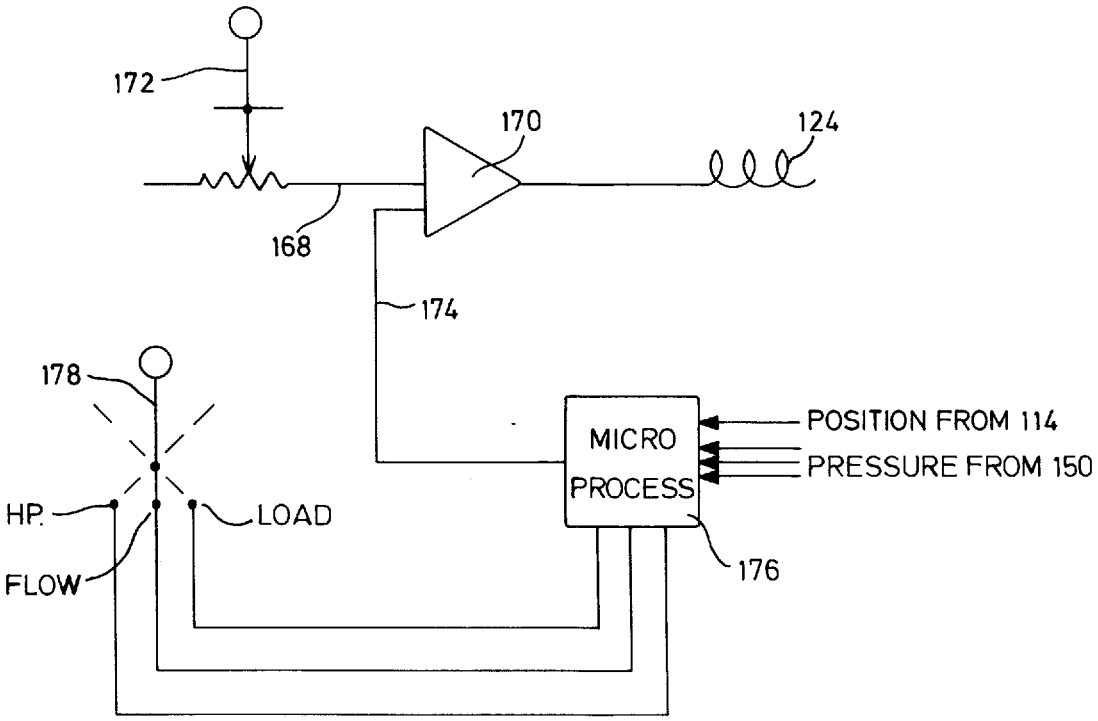
FIG. 7 is a schematic representation of a control function used with the valve of FIG. 1.

The basic components of the electrical control function is shown schematically in FIG. 7 and includes an op amp 170 that drives eth coil 124. It will be appreciated that although a single drive connection is shown, the amplifier 170 regulates both the magnitude and direction of current in the coil 124 to provide bidirectional control for the actuator 78.

The set signal 168 is supplied to the op amp 170 from a manual controller 172 and a feedback signal 174 is supplied from the microprocessor 176. The microprocessor 176 receives input signals from position transducer 114 and each of the pressure transducers 151, 152, 153 and combines them in a manner determined by internal program instructions as selected by a function selection signal 178. The microprocessor 176 may also include a lookup table that correlates the combination of received input signals to an appropriate feedback signal 174 to take into account the characteristics of the particular valve as will be described more fully below.

The operation of the valve will be described, assuming that it functions as a pressure compensated flow controlling directional control valve intended to maintain the flow to one of the supply passages 18, 20 constant as the pressure in supply line 16 fluctuates. The control function implemented by microprocessor 176 is shown schematically in FIG. 8. Assuming, therefore, that the valve 10 is initially close centered as indicated in FIG. 1 with fluid locked in the supply lines 18, 20 and system pressure 16 being delivered to the chamber 38, the armature 126 will be centralized and equal and opposite pressures applied to the spool 40 in the end chambers 106. The spool 40 thus remains balanced with no flow to either of the supply lines 18, 20.

Upon application of a control signal through signal line 168 indicating that flow is required to the supply passage 18, the amplifier 170 supplies current to the coil 124 to move the armature 126 in a direction to connect the control duct 72 to the tank 142. The pressure in control duct 74 is therefore greater than in duct 72 causing the spool 40 to be displaced axially against the spring assembly 108 so that the groove 80 on the spool 40 bridges the delivery passage 18 and pressure delivery duct 16. At the same time, the groove 84 bridges the supply duct 20 and tank duct 24 so that pressure is supplied to supply duct 18 and flows to tank from supply duct 20.

Movement of the spool 40 is monitored by the Hall effect sensor 114 that provides a feedback signal to the microprocessor 176. The microprocessor 176 also receives signals from the pressure transducers 151, 152 indicative of the differential pressure across the spool 40 with the position signal 114 being utilized to identify the transducer associated with the passage 18, 20 connected to supply 16). The look up table 177 in microprocessor correlates the position signals with a family of curves indicating flow rates obtained for different positions of spool 40 over a range of differential pressures to provide a feedback signal 174 that indicates the flow rates that will be attained for those conditions. The set signal 168 and feedback signal 174 are compared by amplifier 170 and the current to the coil 124 is progressively reduced so that the spool 40 remains in the desired position as long as the feedback signal 114 balances the external signal 168.

Fluctuation of the pressure differential across the valve 10 would generate a different flow rate for the same position of the spool 40. Fluctuations in pressure differential are sensed by the pressure transducer assembly 150 so that an error signal is provided to the amplifier 170. A corresponding current is provided to the coil 124 causing it to adjust the differential pressure in the pilot chambers 106 and allow the spool to move in a direction to maintain the flow at the established rate. This signal will be balanced and the valve hydraulically locked by the variation in the position signal from the transducer 114.

For example, if the pressure supplied at the delivery passage 16 increases or the pressure in delivery passage 18 decreases, this would indicate for a given spool position an increased flow rate to the supply passage 18. The increased pressure differential signal, therefore, causes the armature 126 to be moved to displace the spool 40 axially and reduce the orifice defined between the radial flange 82 and the end surface 48 of the central ring 42.

Figure 8:
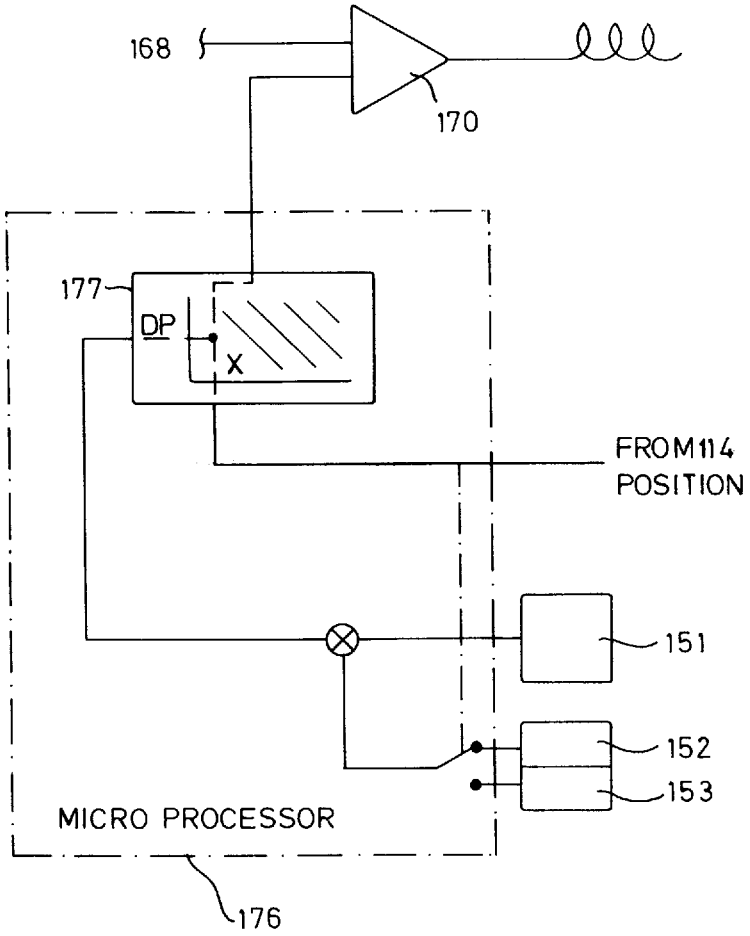
FIG. 8 is a schematic representation of one control strategy using the valve shown in FIGS. 1–4 as a pressure compensated flow control valve.

As shown in FIG. 8, the valve 10 is shown as flow controlling the fluid supplied to the circuit which would act, for example, as a velocity control. A similar effect may be obtained by monitoring the pressure differential on the discharge side to limit, for example, the rate of drop of a load. In this came, the function selector 178 conditions the microprocessor 176 to combine the input signals of position transducer 114 and the transducer 153 associated with passage 20 to maintain a predetermined maximum flow rate. In this case, the transducer 153 indicates the differential pressure across the valve 10 as the drain passage 24 may be assumed to be at zero or negligible pressure.

The operation of the function controller 178 may of course be integrated with the operation of the manual controller 172 where a dedicated control is required so that a single controller selects both controlling function and the set value. Thus, if, for example, valve 10 is used to control a double acting cylinder where a constant velocity is required during extension and varying loads may be supported during retraction, then movement of the controller 172 in a direction to extend the cylinder will simultaneously cause a flow controlling function to be selected by the microprocessor 174. Upon reversal of the manual controller 172 to retract the cylinder, a signal indicating a flow controlling function for the discharge will be provided to the microprocessor 176 to combine the input signals of position transducer 114 and the pressure transducer of the discharge port.

Figure 9:
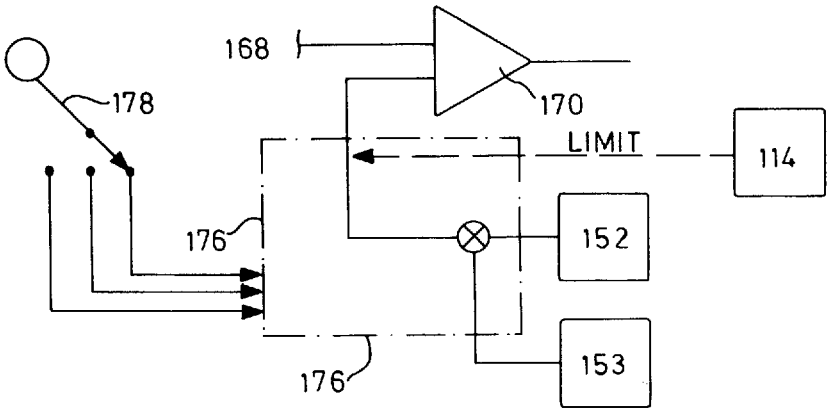
FIG. 9 is a schematic representation of an alternative control strategy using the valve shown in FIGS. 1–4 as a load sensing valve.
Figure 10:
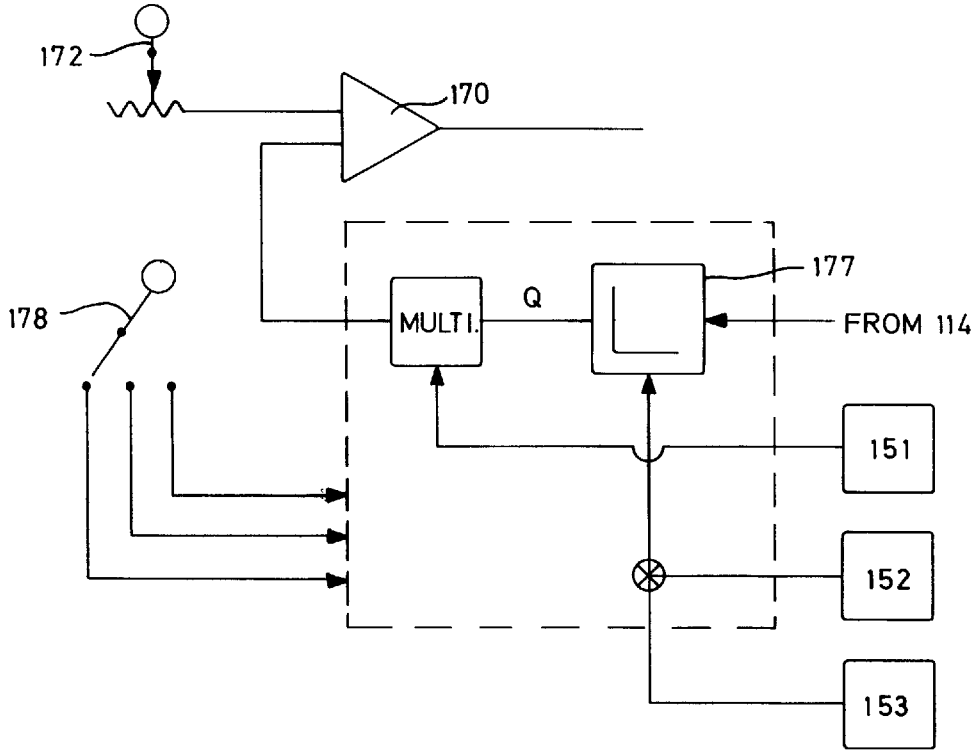
FIG. 10 is a further schematic of an additional control strategy utilizing the valve shown in FIGS. 1–4 as a power limiting valve.

Alternative control strategies using the valve 10 and embodied in the processor 176 are shown in FIGS. 9 and 10. A load control function is shown in FIG. 9 where the force exerted by an actuator is maintained constant. The force exerted by the actuator is the differential pressure between the delivery passages 18, 20 and so microprocessor 176 is conditioned to use the difference of the signals from the transducers 152, 153 as the feedback signal. Accordingly, as the pressure differential varies, the current to the coil 24 is varied to adjust the flow rate through the valve 10. With this strategy, the position feedback 114 is not required but it may be utilized as an override signal to limit the maximum flow rate, i.e. velocity, if appropriate.

The same valve 10 may be used to monitor the horsepower consumed by a circuit connected to the valve 10. This may be useful in a situation where priority must be given to another circuit and the combination of the circuits could overlord the prime mover.

As shown by FIG. 10, the signal from the position transducer 114 is combined with the pressure differential across the valve detected by the transducers 151, 152 was described above to provide an indication of flow rate and the signal from the pressure transducer 150 used to provide an indication of pressure delivered. The microprocessor 176 determines the product of the indicated pressure and flow rate to provide a feedback signal for comparison with the set value 168. The pilot pressures in chambers 106 may be modulated to adjust the flow rate through the valve 10 to maintain the horsepower at a predetermined level. In this arrangement, the selection of a horsepower limiting function may be conditioned by the selection of the priority circuit so that the change in control strategy need not be implemented manually. Similar interaction may be utilized to accord a priority flow to another circuit simply by overriding the set valve of a valve operating in a flow controlling mode.

In all the above embodiments, signals indicative of pressure and displacement are available to the microprocessor. These may be combined to provide the selected control function as required. Clearly, the valve 10 is not limited to a single control strategy and its mode of operation may be changed as circuit conditions change. Accordingly, redundancy of components is avoided and losses kept to a minimum.

It will be seen, therefore, that a very compact easily manufactured hydraulic valve is provided that permits by virtue of the accuracy of manufacture and the position and pressure feedbacks, a versatile control system. While a microprocessor has been shown in the control circuits, it will be appreciated that where the valve characteristics are suitable, an analogue implementation of the combination of the control functions may be used if preferred.

The armature 126 shown in FIGS. 3 and 6 controls the flow of pilot ducts 72, 74 to tank 124. In some implementations, the pilot pressure fluid supply may be separate from the supply to the valve 10 and an alternative arrangement may be used as shown in FIG. 11 where like components will be identified with like reference numerals and a ' added for clarity.

Figure 11:
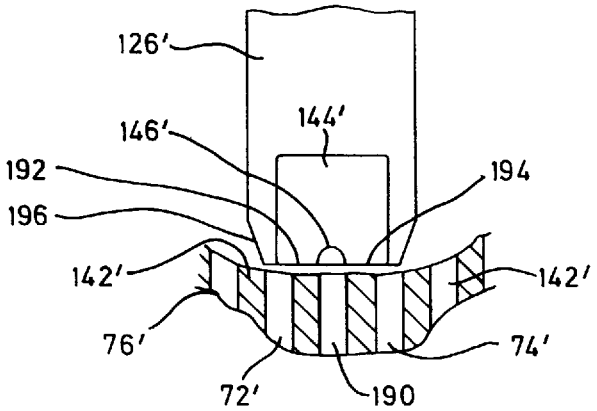
FIG. 11 is a view, similar to FIG. 6, of an alternative arrangement of actuator.

Referring therefore to FIG. 11, the base 76' receives a pilot pressure supply 190 and has radially spaced control ducts 72', 74' to opposite sides. Drain ports 142' are provided radially outwardly of the ducts 74', 74'.

The plug 144' has a central recess 146' dimensional to extend over the pilot supply 190 and is delimited by lands 192, 184. The lands 192, 194 seal the pilot ducts 72', 74' with the armature 126' centered. The flanks 196 of the plug 144' are relieved so as not to cover the tank ducts 142'.

As the current to the coil 124' is modulated, the pressure duct is selectively connected to one of the pilot ducts 72', 74' and the other duct vented to tank. Accordingly, the pilot pressures in chambers 106 are modulated to adjust the spool 40.

This arrangement of armature 126' has the advantage of utilizing the flow forces acting on the recess 146' to assist in centering the armature 126'.

Figure 12:
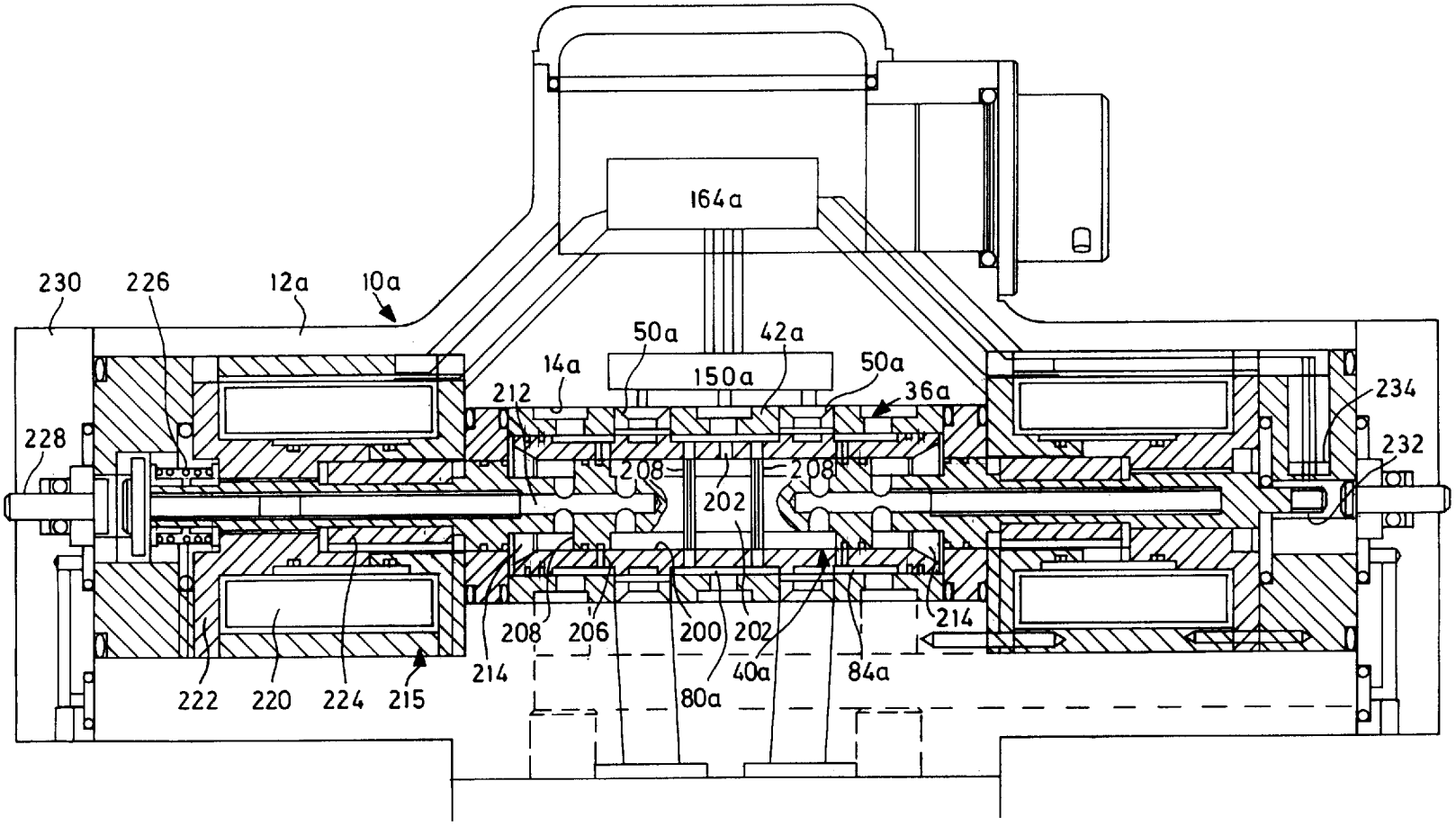
FIG. 12 is a section of a second embodiment of valve.

The manufacturing advantages described above with respect to FIGS. 1 and 2 may also be utilized in a direct acting spool valve as shown in FIG. 12. Like components will be denoted with like reference numerals with a suffix 'a' added for clarity.

In the embodiment shown in FIG. 12, valve 10*a* includes a body 12*a* with an internal bore 14*a* to receive a segmented sleeve 36*a*. The construction of the segmented sleeve is similar to that described above with the central ring 42*a* and the supply rings 50*a* being dimensioned to provide close tolerances as discussed above.

The spool 40*a* is formed as an annular sleeve with an internal bore 200 carrying a control spool 202. The sleeve 40*a* has circumferential grooves 80*a*, 84*a* and 88*a* defined as described above and connected to the pressure supply passage 16*a*, pressure delivery passages 18*a*, 20*a* and tank 24*a* respectively. As such, the formation and arrangement of these grooves will not be described further.

Spool 40*a* carries radial passages 204 communicating between the bore 200*a* and the groove 80*a*. Further radial passages 206 are provided between the groove 84*a* and the bore 200*a* to permit communication between the bore and the tank 24*a*.

The control spool 202 includes a pair of axially spaced lands 208 to cover a pair of the bores 204. An additional pair of lands 210 are also provided to cover the bores 206. Internal bypass passages 212 permit communication across the land 210 to end chambers 214 formed between the spool 40*a* and the sleeve 36*a*. The end chambers 214 are sealed by spacers 216 in which the control spool may slide.

A pair of actuators 215 in the form of solenoid assemblies 218 are located outboard of the control spool 202 and each includes a magnetic coil 220 that operates through pole pieces 222 upon an armature 224 extending laterally outwardly from the control spool 202. A centering spring assembly 226 is located at one end of the armature 224 and a plunger 228 mounted within an end cap 230 and positioned to be operable upon the armature 224 to center the spool manually if so required.

The other of the armatures 224 terminates in a magnetic insert 232 which co-operates with a Hall effect sensor 234 to provide a signal indicative of the position of the spool 202. The signal is provided to a circuit board 164*a* that also receives signals from an external source 168*a* and from pressure transducer assembly 150*a*. The circuit board 164*a* controls current to the coils 220 and so regulates the position of the spool 202 in response to external signal 168*a* as described above.

In operation, the control spool 202 is initially displaced by adjustment of the current to the coils 220. Initial displacement of the spool 202 to the right as viewed in FIG. 3 causes the land 208 to uncover the cross drilling 204 and allow pressure fluid to be supplied through the bypass passage 212 into the end chamber 214. At the same time, the land 210 uncovers the connection to tank 206 at the opposite end of the spool so that the opposite end chamber 214 is vented to tank through the respective bypass passage 212. The pressure imbalance causes the spool 40*a* to be displaced to the right so that the groove 80*a* bridges the pressure port 16*a* and the supply port 20*a*. At the same time, the circumferential groove 84*a* bridges the tank port 24*a* and supply port 18*a* and allows flow to tank.

The initial displacement of the control spool 202 is monitored by the position sensor 234 so that it may be held in the desired position. The spool 40*a* follows the control spool 202 and will be hydraulically balanced when the spool is again centered on the control spool 202. In this position, however, flow can still proceed from the pressure duct 16*a* and tank duct 24*a* through respective ones of the supply passages 18*a*, 20*a*. Because the control spool 202 is not subject to the flow forces associated with the fluid flow, the loads on the spool are reduced and the current to the coils may similarly be reduced once the spool 202 is positioned. Again, fluctuations in pressure may be sensed by the pressure transducer assembly 150*a* and fed through the controller 164*a* to modulate the position of the control spool 202 and with it the spool 40*a* to achieve the various control strategies noted above.

If preferred, the solenoids 218 may be incorporated in a double-acting solenoid at one and of the body 12*a* and provision can be made to connect the armature to the spool through a universal joint that accommodates misalignment and allows axial offset.

Figure 13:
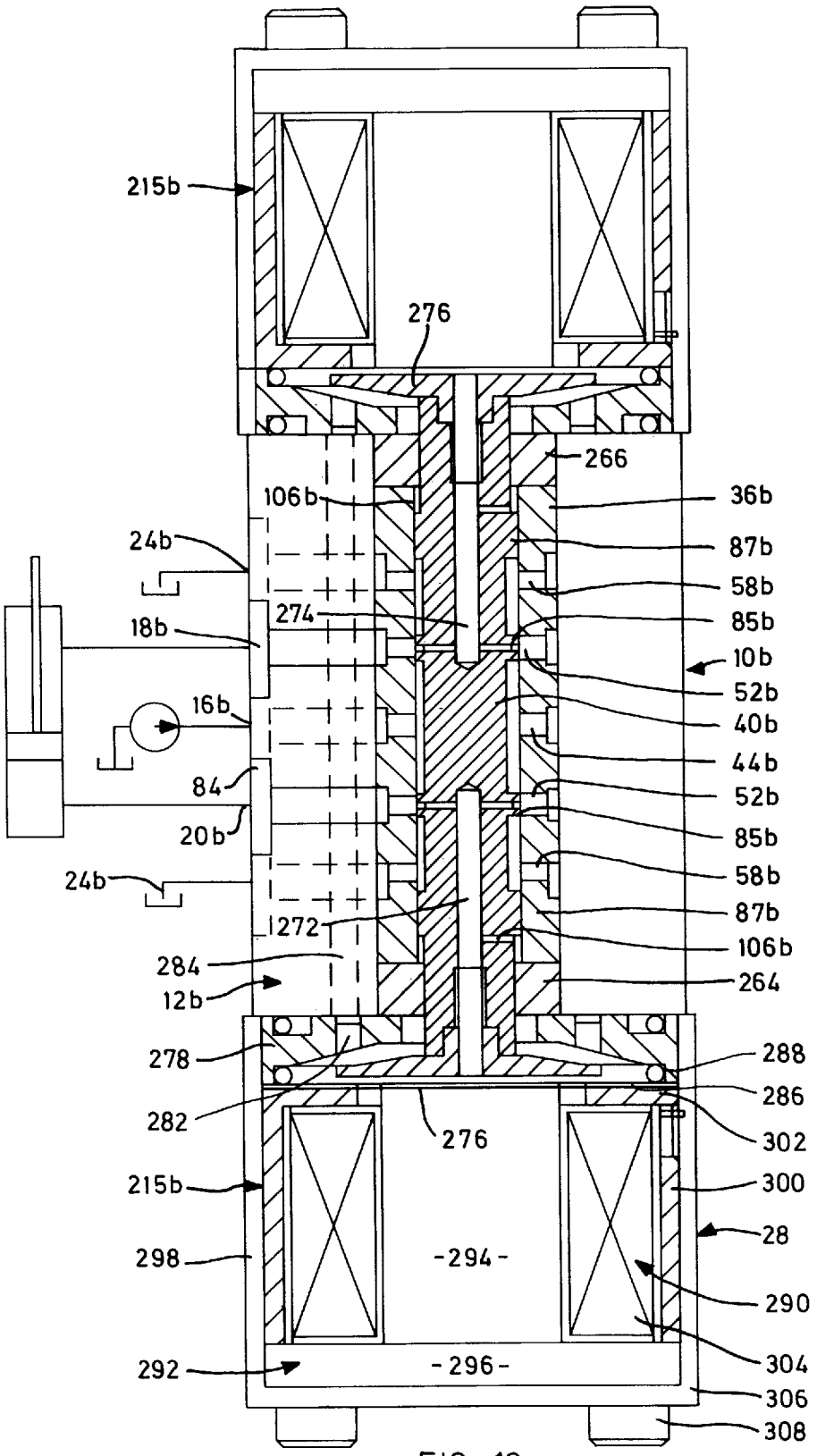
FIG. 13 is a section of a third embodiment of valve using an alternative actuator.

As shown above, the valve 10*a* utilizes actuators in the form of solenoids disposed about extensions of the control spool 202. An alternative arrangement of actuator is shown in FIG. 13 in conjunction with a proportional three-way control valve. It will be understood that such actuators may be used with valves of the type shown in FIG. 12 or FIG. 1.

Referring therefore to FIG. 13 in which like components will be identified with like components with a suffix 'b' added for clarity, a valve 10*b* receives fluid at a pressure delivery duct 16*b* and delivers it to a consumer through a pair of delivery passages 18*b*, 20*b*. Valve 10*b* includes a body 12*b* with an actuator 215*b* disposed at opposite ends of the valve body 12*b*. A ported sleeve 36*b* is located in a bore 14*b* of the body 12*b* and has annular recesses 44*b*, 52*b*, 58*b* aligned with the supply duct 16*b*, delivery passages 18*b*, 20*b* and drain ports 24*b* respectively. Each of the recesses 44*b*,

52*b*, 58*b* is connected by cross drillings 46*b*, 52*b*, 60*b* with the interior 38*b* of the sleeve 36*b*.

A spool 40*b* is positioned within the sleeve 36*b* so as to be slidable along its longitudinal axis. The spool 40*b* includes a pair of lands 85*b* axially displaced from the cross drilling 44*b* and aligned with respective ones of the cross drillings 52*b* and a pair of lands 87*b* are located axially outwardly of the lands 85*b* and on the opposite side of the cross drillings 58*b*.

Opposite ends of the spool 40*b* are supported in end plates 264, 266 which extend from the bore 14*b* to the spool 40*b* and axially locate the sleeve 36*b*. A pressure chamber 106*b* is formed between the end plates 264, 266 and the lands 87*b* and is connected through internal passages 272, 274 with the cross drillings 52*b*. Accordingly, the pressure in the delivery passages 18*b*, 20*b* is applied through the internal passages 272, 274 to the pressure chambers 106*b*.

The spool 40*b* extends through the end plates 264, 266 and is connected to respective radially extending discs 276. Each of the discs form a part of the actuator 215*b* which are identical in construction and therefore will only be described in detail with the same reference numerals denoting like components in each actuator. A closure plate 278 is located between the disc 276 and the valve body 12*b* and is sealed against the valve body 12*b* by O rings 280. An aperture 282 in the closure plate 278 is aligned with a connecting duct 284 that extends through the body 12*b* to the opposite actuator. The duct 284 allows fluid to flow through the duct 284 between the actuators 215*b* as the spool 40*b* moves.

A diaphragm 286 is supported on the closure 278 an the opposite side of the disc 276 to the valve body 12*b*. An O ring 288 seals the diaphragm which isolates an electromagnet assembly 290 from the hydraulic components.

Each electromagnet assembly 290 includes a central pole piece 292 having a cylindrical boss 294 and a radially extending head 296. An outer pole piece 298 is formed with a tubular body 300 and a radially inwardly extending flange 302. A coil 304 is located between the pole pieces 292, 298 and a cover 306 secured by bolts 308 over the electromagnet assembly to the valve body 12*b*.

The pole pieces 292, 298 are dimensioned so that when the end of the boss and the flange abut the diaphragm 286, the opposite end of the tubular body 300 is in contact with the head 296. A magnetic flux path is thus provided with a pair of concentric poles directed toward the disc 276.

The disc 276 extends radially across the poles so that a continuous magnetic flux path is provided from one pole 292 through the disc 276 to the other pole 298. The poles are coplanar and are arranged so that similar areas are provided on each to avoid a restriction in the flux path.

In operation, the force imposed on the spool 40*b* is modulated by varying the current supplied to the coils 304 in each of the actuators 215*b*. Movement of the spool 40*b* downwardly as viewed in FIG. 13 connects the pressure delivery duct 16*b* to supply 18*b* as one of the lands 85*b* uncovers the cross drilling 52*b*. At the same time, the other of lands 85*b* connects the delivery passage 20*b* with the drain 24*b*.

The pressure supplied through the delivery passage 18*b* is also applied through passage 272 to the pressure chamber 106*b* and seeks to move the spool 40*b* back to a centered position. The electromagnetic assembly 290 provide a constant force determined by the current supplied so that variations in the pressure will modulate the flow supplied through the delivery passages 18*b*, 20*b*. Accordingly, a pressure controlled valve is provided. Increased flow rates may be obtained with an increased current supplied to the coil and again will be pressure controlled due to fluctuations in the pressure at the delivery passages 18*b*, 20*b*.

A highly linear modulation can be obtained due to the configuration of the electromagnet assemblies 290 and in particular the concentric radially spaced and coplanar pole pieces 292, 298. The configuration of pole pieces 292, 298 and disc 276 provide a large cross sectional area thereby inhibiting the magnetic saturation of the components. At the same time, a single air gap is provided between the operating member in the form of the disc 276 and the magnetic poles.

The pressure chambers 106*b* may be sized so that the forces imposed on the valve by the pressure of fluid match those available from the electromagnetic actuators 290. Thus with low pressure ranges a relatively large area many be utilized to balance the forces over a full range of movement and vice versa.

The valve shown in FIG. 13 may also be used in combination with position feedback to obtain a flow control by varying the current supplied as the position of the spool 40*b* varies and is inherently force controlling as excess pressure will force the spool 40*b* to a position in which the high pressure line is connected to tank.

The spool 40*b* provides an increased bearing surface for the actuators to reduce hysteresis and the radial spacing of the poles provides a compact design that permits relatively high forces to be generated on the spool.

Although pressure feed back has been illustrated, it will be appreciated that other biasing means could be used, such as a spring to obtain proportionality of the valve.

It will also be appreciated that the actuators shown in FIG. 13 may be utilized to control the pilot pressures in the embodiments of FIG. 1 and 2 including a pilot stage located at opposite ends of the spool and having a control member which is movable toward and away from a controlling orifice to adjust the pilot pressures acting upon the spool. Such an actuator is shown in FIG. 14 and embodied in a cartridge configuration of valve.

Figure 14:
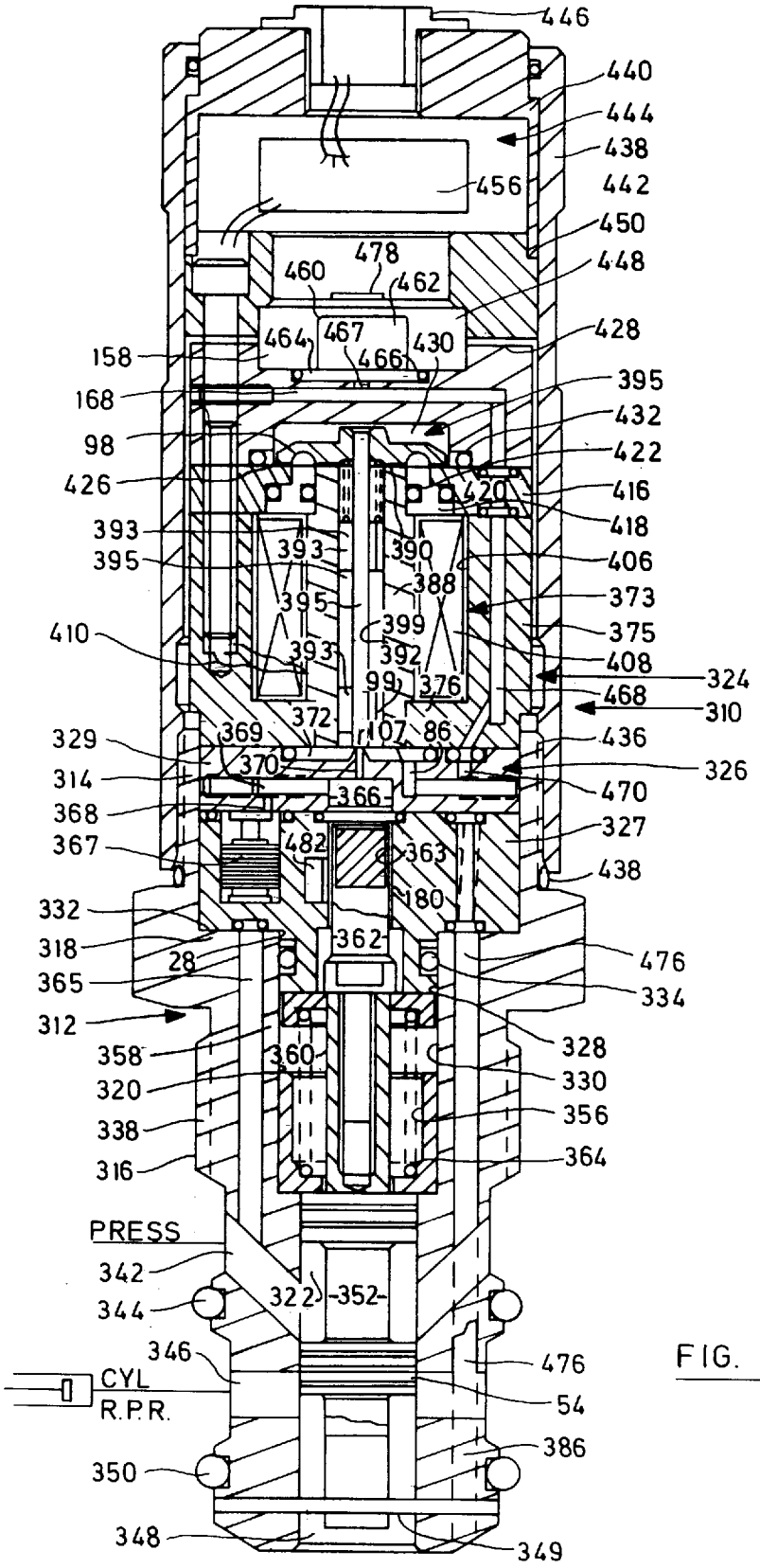
FIG. 14 is a section of a fourth embodiment of proportional valve employing a pilot operated stage.

Referring therefore to FIG. 14, a valve generally indicated at 310 has a housing 312 formed by a pair of concentric tubular bodies 314, 316 interconnected by a radial web 318. The bodies 314, 316 define a stepped bore 320 that extends through the housing 312.

The bore 320 is partitioned into a valve chamber 322 and actuator chamber 324 by an orifice assembly 326 that has a stepped body 327 and an orifice plate 329. The body 327 has an outer cylindrical surface 328 that is received in the bore 320 of the lower body 316 and is axially located in a radial shoulder 232. An O ring 334 seals the orifice assembly 226 in the bore 320.

The lower body 316 is configured to be received within a valve block 336 and has an external thread 338 to secure the valve 310 in the block 336. The lower body 316 will be configured to provide ports for communication with galleries within the valve block 336 depending upon the configuration of the valve 310. In the embodiment shown in FIG. 10, the valve 310 has a pressure inlet 342 separated by means of an O ring 344 from a supply port 346. The supply port 346 is sealed from a tank port 348 by means of an O ring 350.

Flow between the inlet port 342, tank port 348 and supply port 346 is controlled by a valve spool 352 that is slidably received within the bore 320 in the valve chamber 322 and prevented from rotating by a pin 249. Spool 352 has a land 354 that may be positioned over the supply port 346 to control flow through the port 346 to either the inlet port 342 or the tank port 348.

A spring 364 is located between a pair of collets 356, 358 located within the bore 320 between the spool 352 and orifice plate assembly 326. An extension 360 of spool 352 extends through the collets 356, 358 and carries a transducer head 362 that is slidable in a bore 363 provided in the body 327 of orifice assembly 326. The collets 356, 358 are seated against respective shoulders on the spool 352 and the orifice assembly 326 so that movement of the spool 352 in either direction is opposed by the spring 364. The transducer head 362 carries a magnetic insert 480 that is aligned with a Hall effect sensor 482 secured in the body 327. Movement of the spool 352 thus changes the flux detected by the sensor 482 and provides a signal indicative of the position of the spool 352.

The bores 320 and 363 define a pilot pressure chamber 366 between the spool 352 and orifice assembly 326. Pressure in the pilot chamber 366 acts to move the spool 352 against the bias of spring 364 and to vary the position of land 354 relative to the supply port 346.

Fluid is supplied to the chamber 366 by an internal duct 365 that extends from the pressure port 342 through a filter 367 in the body 327 to a radial supply passage 369 in the plate 329. A flow control orifice 368 is positioned between the filter 367 and passage 369 to regulate the flow ratio into the chamber 366.

The plate assembly 329 includes a centrally located orifice 370 surrounded by an annular recess 372 that is directed toward an electromagnet assembly 373. The orifice 370 has a significantly greater flow capacity than the orifice 368 so that flow into the chamber 366 is limited by orifice 368 and its pressure modulated by controlling flow through orifice 370. A drain passage 384 is provided in the plate 329 and body 327 to communicate with drain passages 386 formed in the lower body 316 and extending to the tank passage 348 provided in the valve block 336.

The flow through orifice 370 in modulated by an electromagnetic assembly 373 located with the actuator chamber 324. The electromagnet assembly 373 includes a pole piece 374 that has a cylindrical skirt 375 and a radially extending head 376 that abuts the plate 329. A central boas 388 extends upwardly through the actuator chamber 324 and terminates in a radial face 390. A bore 392 is provided through the boss 388 in alignment with the orifice 370 and a pair of bushes 393 are spaced along the bore 392 to support an operating member 395.

The boas 388 and skirt 375 define a cavity 406 in which an electrical coil 408 is snugly located. The coil 408 is wound in conventional manner and encapsulated in insulation so as to be snugly received on the boss 388 with leads 410 extending upwardly through the housing 312 to a power source.

An outer pole piece 412 is formed on the skirt 375 by a radial flange 416 that engages the coil 408 to locate it axially. A non-magnetic annular plug 418 is located between the boss 388 and the flange 416 and sealed by O rings 420, 422 to prevent the ingress of fluid into the coil 408.

The electromagnet assembly 373 thus provides a pair of radially spaced concentric poles in the form of an upwardly directed face 426 of the flange 416 and the radial face 390 of boss 388. The poles are arranged to be of a similar surface area to provide a uniform flux path.

Operating member 395 includes an elongate non-magnetic piston 396 that is slidably received in the bushes 393 in boss 388 and is connected to a disc 398 that extends radially across the radial faces 390, 426. Slots 399 are formed in the bushes 393 to promote free flow of fluid along the bore 392. The piston 396 has a planar lower end 407 juxtaposed with the orifice 370. The piston 396 co-operates with the orifice 370 to define an annulus to between the end 407 and the orifice 370 that regulates the rate of flow of fluid through the orifice 370.

A partition member 428 is supported on the flange 416 of the pole 374 and has a cavity 430 that extends across the disc 398. An O ring 432 seals between the flange 416 and the partition member 428 to define a fluid tight chamber in which the disc 398 is located.

A diaphragm plate 448 is located between the partition member 428 and a retaining ring 450. The diaphragm plate 448 has a skirt 458 that engages the partition member 428 and a planar end surface 460 spaced from the partition member 428. The skirt 458 and end surface 460 define a cavity 462 that overlies a recess 464 formed in the partition member 428 and sealed by an O ring 466.

Fluid is supplied to cavity 462 through a hole 467 that communicates with an internal duct 468. Internal duct 468 extends from the cavity 462 through the partition member 428 and flange 416 into the skirt 375. The duct 468 is aligned with a passage 470 in the plate 329 and body 327 that is aligned with a passage 476 provided in the lower body 316. The passage 476 extends to the supply port 346 so that the pressure in supply port 346 is transmitted to the cavity 462 within the diaphragm plate 448.

A cap 434 is secured to the housing 312 by screw threads 436 and is hermetically sealed by an O ring 438 located between the cap 434 and the housing 312. The cap 434 carries a cylindrical insert 440 having an annular lower edge 442 that engages the upper surface of the retaining ring 450 and thus axially locates it within the housing 312. The cap 434 therefore is effective to secure the components within the housing 312 and prevent relative axial movement between the pole pieces, coil and the closure member. The cap 434 also defines a cavity 444 through which the leads 410 pass and accommodates a control circuit board 456 receiving control signals through an electrical connector 446.

A strain gauge 478 is mounted on the end surface 460 of diaphragm plate 448 to provide a pressure transducer connected to the circuit board 456. The details of the board 458 and its control functions will be a matter of choice or design depending upon the nature of the control function to be implemented and will not be described further at this time. As noted above with respect to FIGS. 1 to 10, the provision of pressure sensing at a port and position sensing of the spool permits the implementation of different control strategies in a simple yet effective manner.

In operation, fluid will be supplied to the pilot pressure chamber 366 from the inlet port 342 during initial operation of the valve. Flow from the pilot chamber 366 is controlled through the orifice 370 by the spacing of the end surface 407 of piston 396 from the orifice 370. Axial movement of the piston 396 is controlled by modulating the current supplied through the leads 410 to the coil 408. The coil establishes a magnetic flux through the pole pieces 374, 412 and the magnetic circuit is completed through the disc 398. The force on the disc 398 in proportional to the current supplied and is opposed by the flow through the orifice 370. By modulating the current, the piston 396 will move toward or away from the orifice and hence control its flow rate and thus the pressure within the pilot chamber 366. Fluid flowing through the orifice 370 may flow through the slot 384 to tank. In the embodiment of valve shown, an increased current will move piston 396 toward the orifice 370, hereby reducing the annulus end increasing the pressure in chamber 366. The spool 352 will move downwardly against the bias of spring 364 to allow fluid to flow from inlet port 342. As the spool 352 moves downwardly, the signal from the position transducer 480, 482 is varied providing a control signal to the board 456.

In the embodiment shown in FIG. 14, the pressure sensing passage 470 is connected to the supply port 346 to sense the pressure supplied to the remote cylinder. The spool 352 is used to throttle flow between the cylinder and either the pressure port 342 or the tank port 348 and is modulated by variations in the sensed pressure to maintain the pressure at port 346 at a preset level.

It will be noted that the valve 310 is effective to control flow between the supply port 346 and tank port 348 to provide, for example, a controlled drop of the load. The signal from the sensor 482 indicates the spool position to either side of the a neutral, no flow, position and accordingly the set signal may be used to indicate a desired flow to tank. The pressure transducer 456 then monitors the pressure at port 346 and modulates the pressure in the pilot chamber 366 to maintain that pressure as described above.

It will be noted that a single air gap is provided between the disc 398 and the plane of the pole pieces defined by the radial face 390 and face 426 and that air gap is minimized as a barrier is not interposed between the disc and the poles. Once the actuator 395 has been inserted into the pole piece 374, the pole piece may be ground flush with the end face 407 of the piston 396 and once calibrated, will provide consistent results. A spacer may be inserted between the disc 398 and pole piece during grinding so that, in use, an air gap will always be maintained between the disc and pole pieces. The concentric arrangement of the pole pieces also provides a significant surface area of the poles to avoid premature saturation. This allows a wide force range to be utilized to increase the applicability of the pilot stage. At the same time, a highly linear force/current curve is obtained to enhance the proportionality of the valve.

The arrangement of piston 396 is particularly beneficial as its planar end 407 does not introduce significant side loads on the piston. Moreover the annulus defined between the piston 396 and orifice 370 allows a relatively large change of control area for a relatively small displacement which ensures a good linearity.

The use of the orifice 370 also allows the full line pressure to be utilized in the pilot stage as the forces generated on the piston 396 are determined by the area of the orifice. Thus, although a relatively high pressure may be used, the force on the piston is small although a full range of modulation is still available by adjustment of the piston.

The actuator described above permits progressive variation in the pilot pressures over the available range. The actuator may also be used with an "on-off" valve by simply providing maximum and minimum currents to the coil. In this arrangement, the controlling circuit boards may ramp the current charge to provide a "soft" closure of the valve to minimize shock in the hydraulic system.

Figure 15:
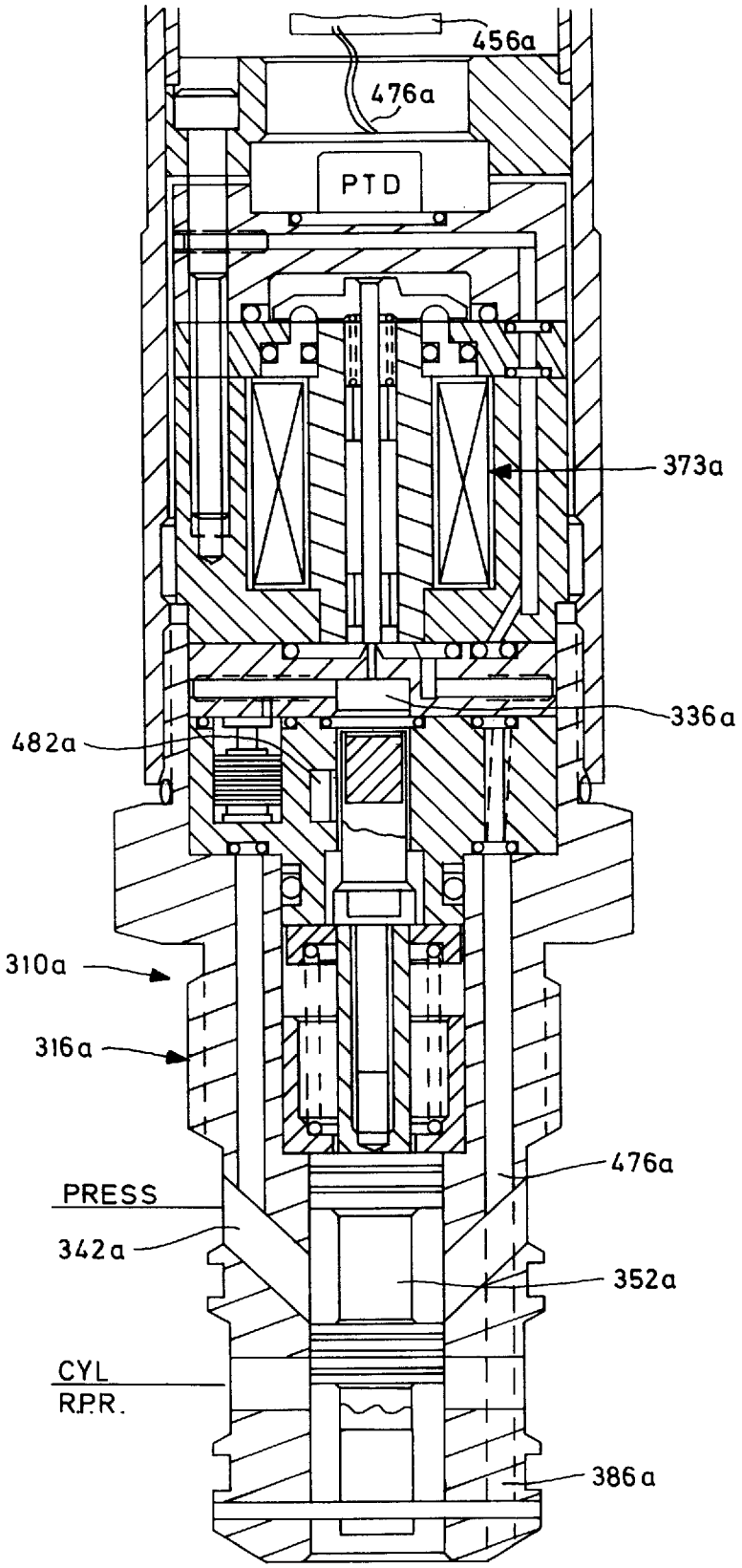
FIG. 15 is a section similar to FIG. 14 of a fifth embodiment of a pilot operated proportional valve.

The arrangement of valve 310 shown in FIG. 14 in also failsafe in the event of power loss to the control board 456 and coil 408. In the event that electrical power is lost, the spring 364 opens the supply port 346 to the tank 348 so that the line from the supply port 346 in at zero pressure with zero flow. Once power is restored, the valve 310 will again be conditioned to supply pressure. An alternative control strategy using essentially the same components to those shown in FIG. 1 may be implemented by referencing the chamber 162 of the pressure transducer to pressure port 42. In this arrangement, a portion of which is shown in FIG. 15 where like reference numerals will be identified by like numerals with a suffix 'a' added for clarity. The pressure sending duct 176*a* intercepts the pressure port 42*a*.

With this arrangement, pressure delivered by the pump may be monitored and the spool adjusted as fluctuations occur. For example, the microprocessor may be implemented to prevent overrun of a load or cavitation of a cylinder which would be signified by a low pressure at port 42*a*. The detection of such a condition would then move the spool to throttle the flow to the tank and maintain the pressure at the port 42*a*.

Figure 16:
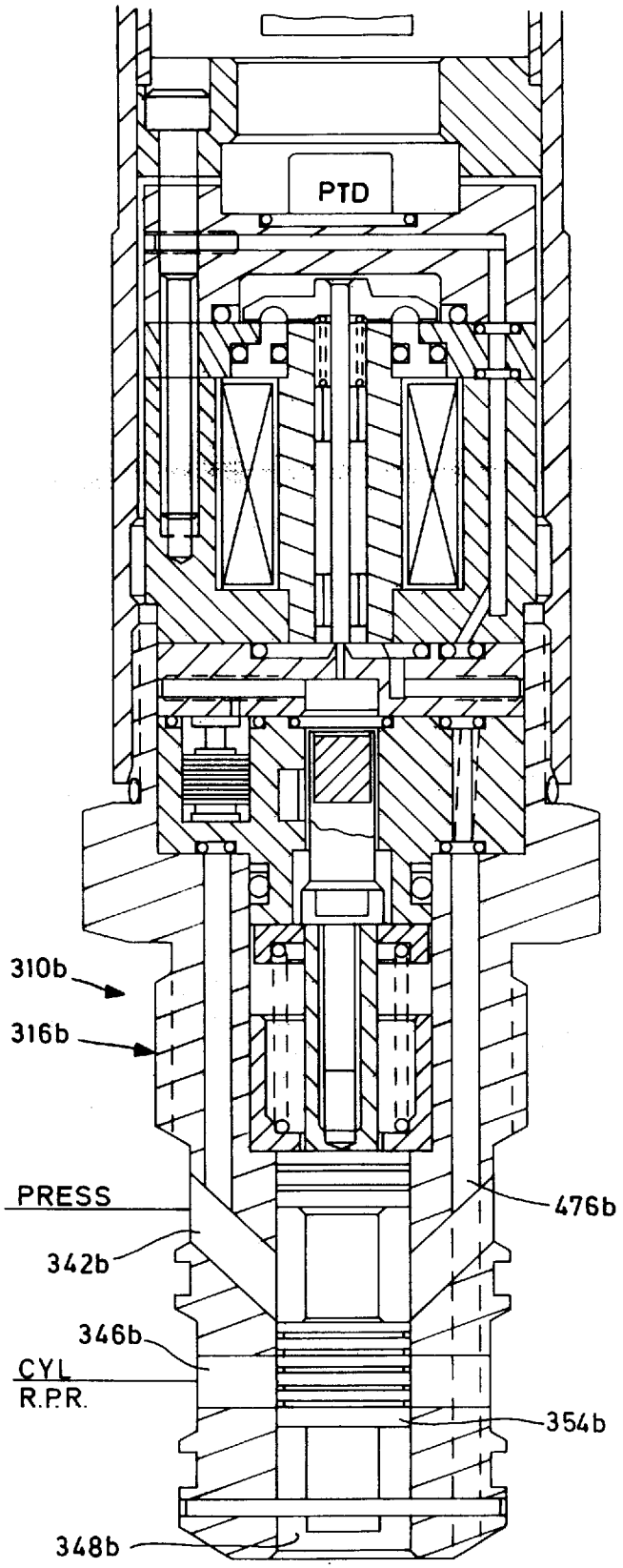
FIG. 16 is a section similar to FIG. 12 showing a sixth embodiment of valve.

A further modification is shown in FIG. 16 where the valve may operate as a flow controlling valve. Like components will be identified with like reference numerals and a suffix 'b' added for clarity.

In the embodiment of FIG. 16, the pressure sensing duct 476*b* is again referenced to the pump pressure and operates essentially as described above. Land 354*b* on the spool 352*b* is however extended axially so as to prevent flow from port 346*b* to tank port 346*b* at all positions. The valve 310*b* thus maintains flow rate from the pressure port 342*b* to supply port 346*b* but does not permit a flow to tank.

Figure 17:
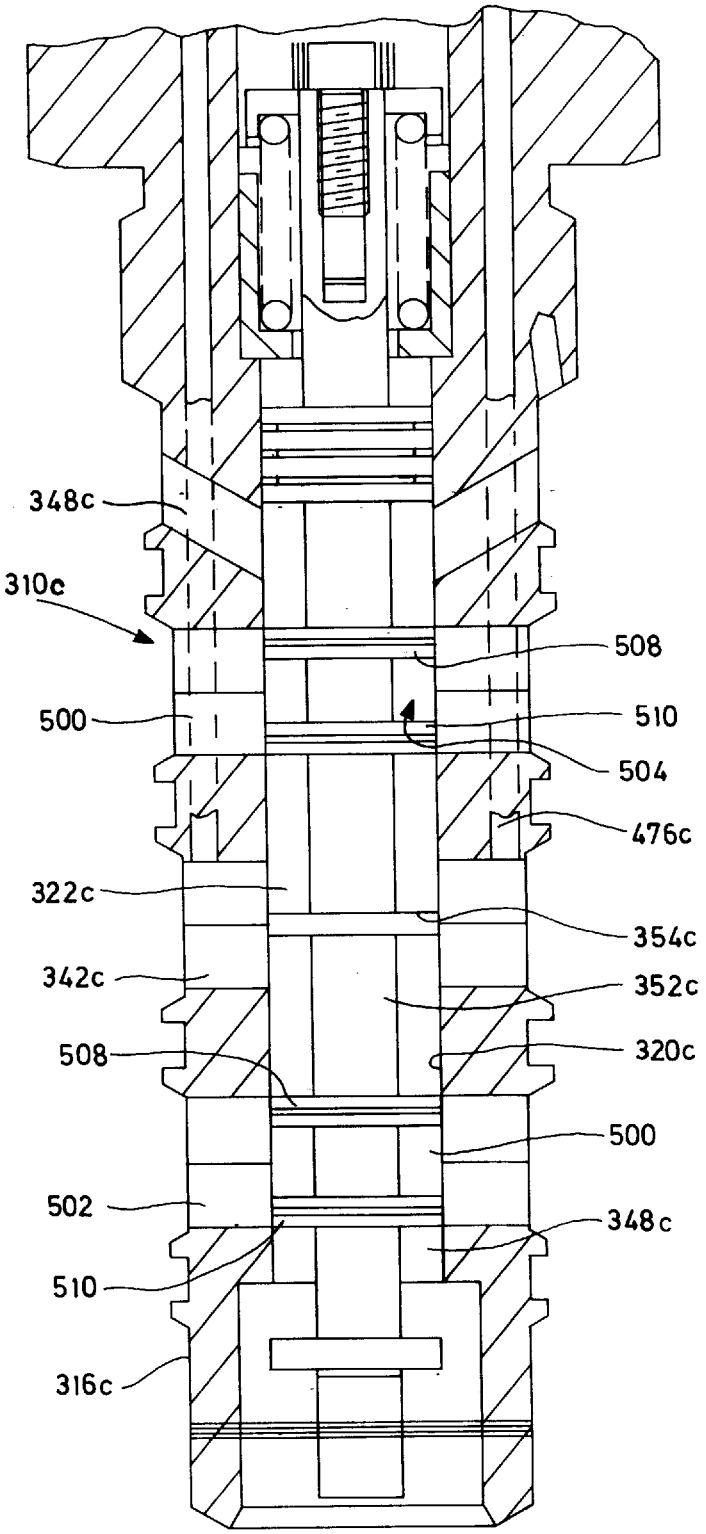
FIG. 17 is a section of a seventh embodiment of proportional valve showing an alternative arrangement of spool.

The above embodiments have utilized a three-way valve to control flow to a single consumer. The actuator and control strategies may also be incorporated in a four-way valve as shown in FIG. 17 where like components are identified with like reference numerals and a suffix 'c' added for clarity. It will be appreciated that the details of the actuator and control are similar to those described above and so have not been shown.

Referring to FIG. 17, valve 310*c* has a lower body 316*c* with a pressure port 342*c*, a pair of tank ports 348*c* and respective supply ports 500, 502.

Spool 352*c* has a central land 354*c* centrally disposed in the pressure port 342*c* and a pair of control lands 504, 506 at each of the supply ports 500, 502. The control lands 504, 506 are defined by spaced flanges 508, 510 each of which forms a seal against the bore 320*c* in the valve chamber 322*c*. The control leads 500, 502 are operable to regulate flow between the supply ports 500, 502 on either the pump pressure or tank, depending upon the direction of movement of the spool 352*c*.

As indicated in FIG. 17, pressure sensing duct 476*c* is referenced to the pressure port 342*c* so that a control signal indicative of the supply pressure is provided from pressure transducer 478*c* (not shown). This is particularly beneficial when used for example with a double acting actuator where the loads may vary significantly depending upon the direction of movement of the actuator. By referencing to the pressure port, the flow rate and hence speed of the actuator may be maintained constant in both directions by modulating the spool position as the pressure fluctuates.

It will be apparent of course that the pressure duct 476*c* could be referenced to one or both of the supply ports 500, 502 to provide a constant pressure supply. This may be useful for example where maximum flow rates are required up to a maximum load.

The position sensor may also be used to limit flow rates in one direction to avoid overrun of the load. It will also be noted that the lands are centered when there is no pilot pressure so that all lines are isolated in the event power is lost. In each case of cartridge valve, a single pressure transducer assembly has been shown. However, pressure tapping could be taken from each port and an associated transducer incorporated in the cap 434 to allow the implementation of the control strategies described above with respect to FIGS. 1 to 10.

Again, therefore, it will be seen that the provision of a pressure sensing and spool position feedback provides a versatile valve for implementing a number of different control strategies and that the actuator described above with respect to the embodiment of FIG. 13 may be utilized in a pilot stage of a proportional valve.

Figure 18:
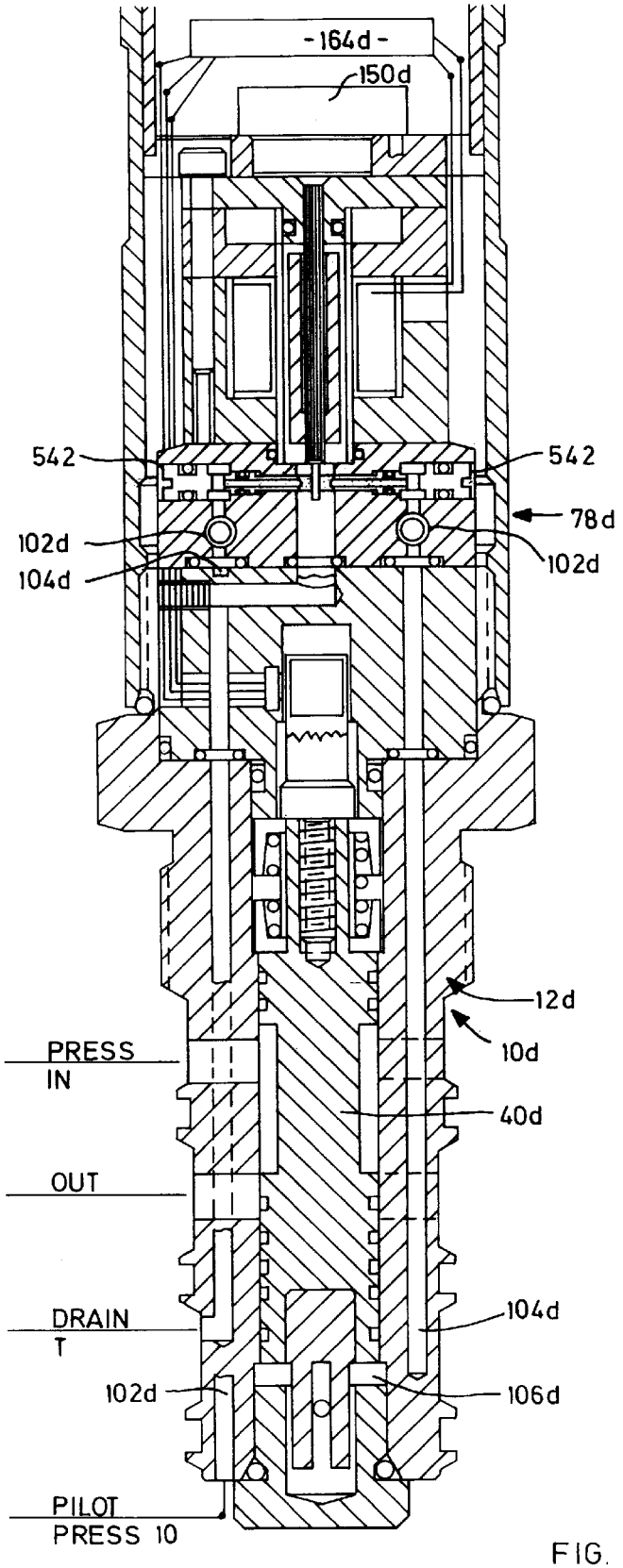
FIG. 18 is a sectional view similar to FIG. 14 of an eighth embodiment of valve utilizing an alternative pilot stage actuator.
Figure 19:
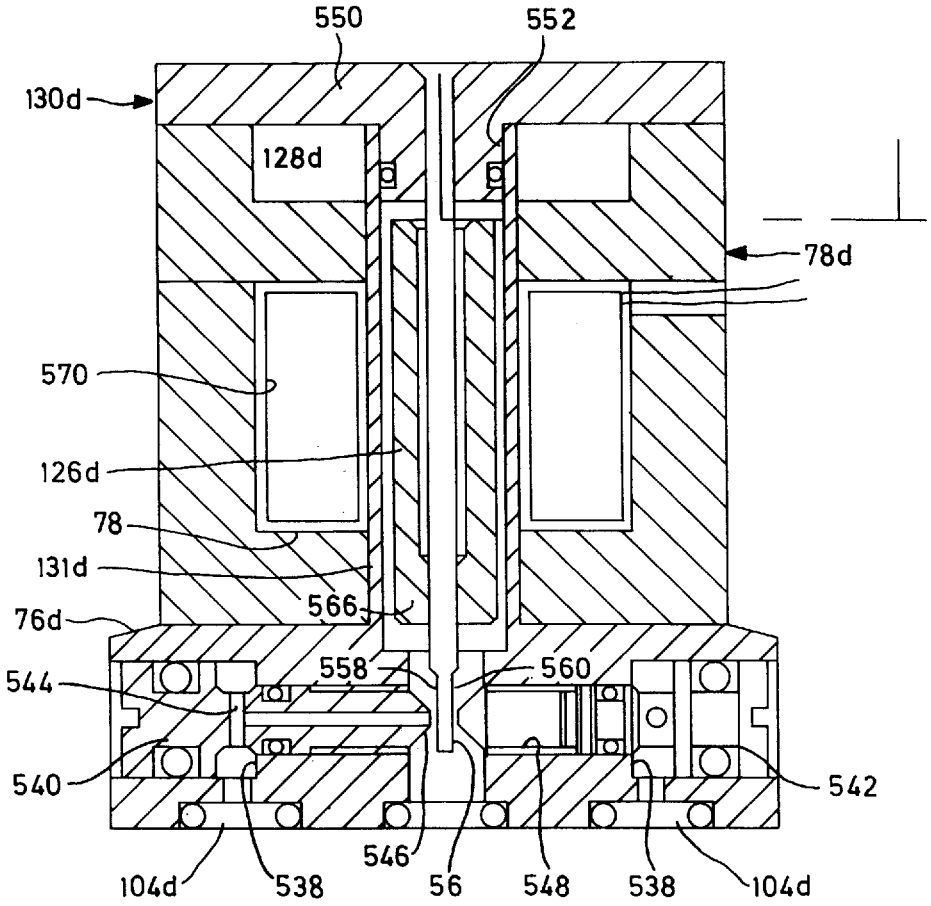
FIG. 19 is a sectional view on an enlarged scale of the actuator used in the valve of FIG. 14.

As seen in FIGS. 18 and 19, a flapper type of pilot stage may also be incorporated into a cartridge assembly. A hydraulic valve generally indicated at 10*d* includes the valve body 12*d* with a spool 40*d* slidable within the body 12*d*. A pilot pressure feed is supplied through a duct 102*d* and individual pilot flows are delivered through respective internal ducts 104*d* to one of a pair of chambers 106*b* at opposite ends of the spool 40*d*. A differential pressure in the chambers 106*d* thus displaces the spool within the body 12*d* to control flow between a pressure delivery duct 16*d* and a pair of delivery passages 18*d*, 20*d*. The details of the spool 40*d* and its relation to the ports 16*d*, 18*d*, 20*d* are provided by way of example only and need not be described further. It should be noted that by adjusting the differential pressure acting across the spool 40*d*, control of the stage provided by the spool 40*d* can be obtained.

Similarly, pressure taps and transducers assembly 150*d* may be incorporated into the body 12*d* as shown schematically to provide the control strategies required in conjunction with a controller located above the pilot stage.

The pressure supplied in the ducts 102*d* is modulated in a pilot stage indicated at 78*d*. The pilot stage 78*d* is shown in further detail in FIG. 9 and includes a base 76*d* with a tubular spacer 131*d* projecting upwardly from the bas 76*d*. The base 76*d* includes a pair of diametrically opposed stepped bores 538 each of which receives a nozzle 540, 542 respectively. Each of the nozzles 540, 542 has an internal passageway 544 that terminates in an orifice 546. Each passageway 544 communicates with a respective one of ducts 104*d* so that modulation of the flow through the orifices 546 also modulates the control pressures supplied though the ducts 104*d*.

Each of the nozzles 540, 542 is secured in the bores 536 by screw threads 548 to adjust the radial projection of the nozzle 540, 542.

A cap 550 of housing 130*d* is supported on the tubular spacer 131*d* with a boss 552 toward the nozzles 540, 542. A pin 128*d* is secured in the cap 550 and projects toward the nozzles 540, 542. The distal end 556 of the pin 128*d* is flattened to provide a pair of oppositely directed planar surfaces 558, 560 that overlie the orifices 546 but are spaced from them. Movement of the surfaces 558, 560 toward or away from their respective orifices will adjust the flow rate through the orifice and thus modulate the pressure in the passageways 544.

An armature 126*d* of magnetic material has a radially inwardly projecting collar 566 connected to the pin 128*d* adjacent the end 556. The armature 126*d* is relatively spaced from the pin 128*d* so as to provide a lever to exert a couple on the pin 128*d* through the collar 566.

An electromagnetic assembly 570 similar to that shown above at FIGS. 4 and 5 is mounted on base 76*d* to provide a pair of semi-circular pole pieces 120*d*, 122*d* about the armature 126*d*. As the details of the pole pieces are as described above, no further description is necessary at this time. As noted above, the provision of the pair of poles on the armature and the arrangement of the pole pieces at axially spaced locations along the armature provides a significant improvement in the electromagnetic forces generated and thereby allows accurate modulation of the pilot pressures. It will be noted that the magnets and pole pieces abut over a relatively large surface area providing optimum flux transfer but at the same time the spacing of the pole pieces by the magnets inhibits the flux transfer between the flanges 135*d*, 137*d*. Although the pin 128*d* and armature 126*d* require the central spaces of the poles to be increased, the armature 126*d* provides a magnetic path at the centre of the flanges 135*d*, 137*d* to increase the flux density at that location.

The collar 566 is located at the pole piece remote from the boss 552 so that the maximum deflection is obtained with a given couple. At the same time, the arrangement may be accommodated within the orifices of a cartridge valve.

The arrangement of the nozzles 540, 542 within the base 76*d* also facilitates initial setting of the nozzles. In order to set the nozzles accurately relative to the end 556, pressure is supplied to the passages 544. The pressure in each of the passages is monitored and the nozzle is adjusted by rotation within the bores 538 until the pressures are equal and are at the mid-range of the design operating pressures. In that location it is known that the nozzles are equidistant from the end 556 and, with no current flowing through the coil, the control pressure will be in the mid-range of that used in the valve. The position of the nozzles in the bores 538 is then fixed by application of sealing compound and a sealed unit thus provided.

The actuator shown in FIGS. 18 and 19 may of course be used in conjunction with the valves shown in the above embodiments to implement the modulation of the pilot pressures controlling the spool 40. In each case, current supplied to the coil modulates the pilot pressures to implement the desired control strategy.

Figure 20:
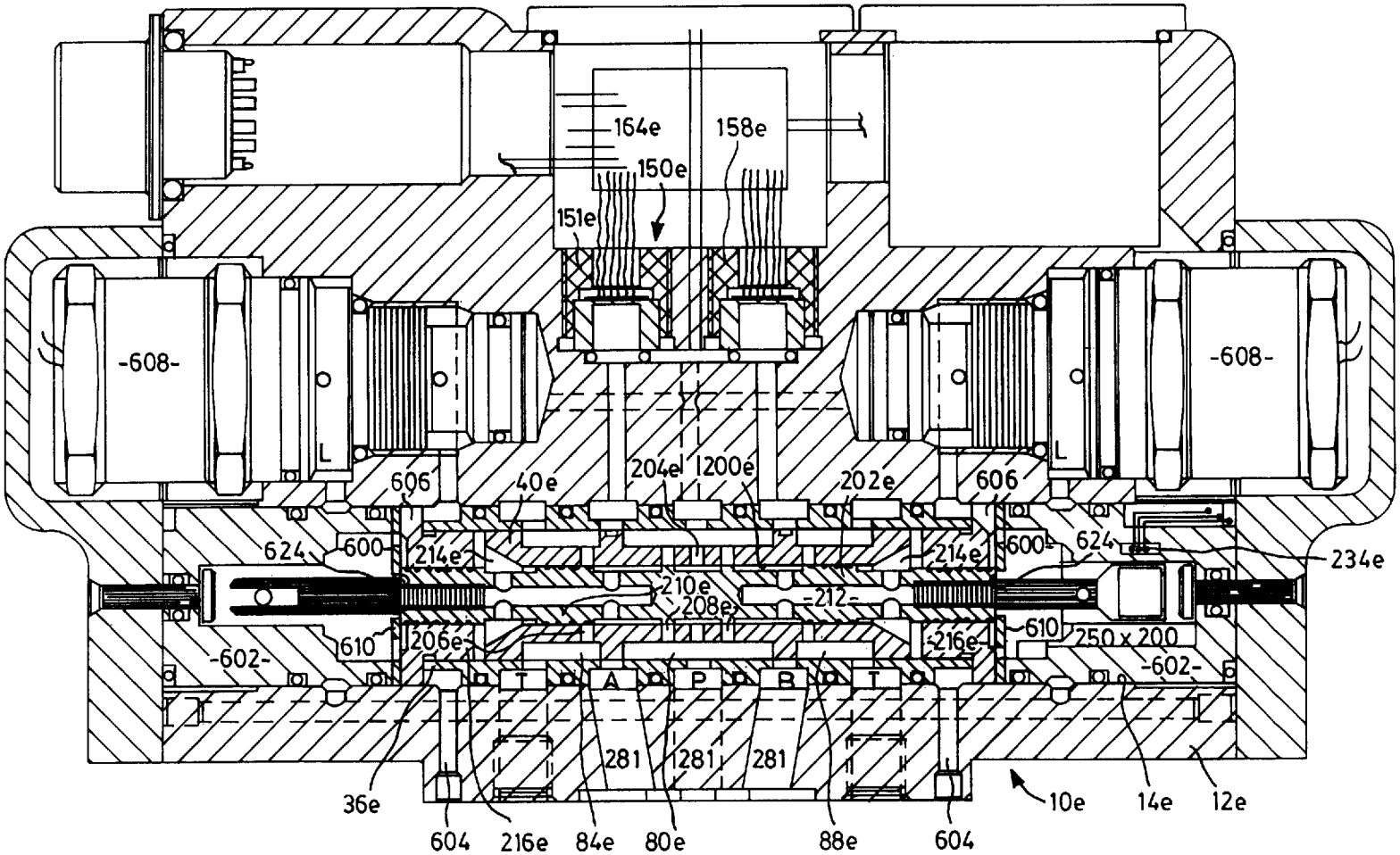
FIG. 20 is a sectional view of a further embodiment of a valve similar to that shown in FIG. 12.
Figure 21:
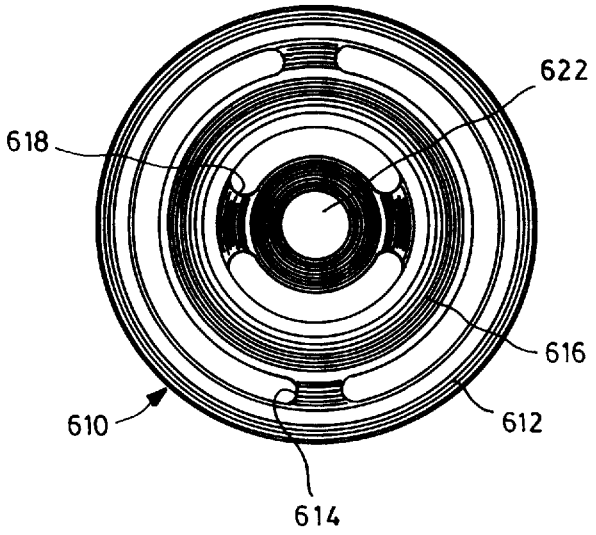
FIG. 21 is an end view on the line 21—21 of FIG. 20.

A further embodiment of valve similar to that of FIG. 12 is shown in FIGS. 20 and 21, Like components will be described with like reference numerals with a suffix "e" added for clarity.

In the embodiment shown in FIG. 20, valve 10*e* includes a body 12*a* with an internal bore 14*e* to receive a sleeve 36*e*. The construction of the sleeve may be similar to that described above with a central ring and the supply rings being dimensioned to provide close tolerances as discussed above or, as shown, may be a single piece.

The spool 40*e* is formed as an annular sleeve with an internal bore 200*e* carrying a control spool 202*e*. The sleeve 40*e* has circumferential grooves 80*e*, 84*e* and 88*e* connected to the pressure supply passage 16*e*. The recesses 80*e*, 84*e*, 88*e* define a pair of lands 82*e* that control flow to the pressure delivery passages 18*e*,20*e*.

Spool 40*e* carries radial passages 204*e* communicating between the bore 200*e* and the groove 80*e*. Further radial passages 206*e* are provided between the grooves 84*e*, 88*e* and the bore 200*e* to permit communication between the bore and the tank 24*e*.

The control spool 202*e* includes a pair of axially spaced lands 208*e* to cover the axially outer pair of the bores 204*e*. An additional pair of lands 210*e* are also provided to cover the bores 206*e*. Internal bypass passages 212*e* permit communication across the land 210*e* to end chambers 214*e* formed between the spool 40*e* and the sleeve 36*e*. The end chambers 214*e* are sealed by spacers 216*e* in which the control spool 202*e* may slide.

The spacers 216*e* extend to the bore 14*e* and define control chambers 600 between the spacers 216*e* and end plugs 602. Oil is supplied to the chambers 600 by respective control pressure ports 604 that communicate with the chamber 600 through slits 606 provided in the spacers 216*e*.

Pressure in the chambers 600 is modulated by proportional pressure control valves 608 which adjust the pressure in the chambers 600 in response to variations in electrical control signals supplied to the valves. The pressure control valves 608 may be of any convenient form but conveniently may utilize an actuator similar to that shown in FIGS. 14 or 15 to modulate the pressure in the chamber 600.

Figure 22:
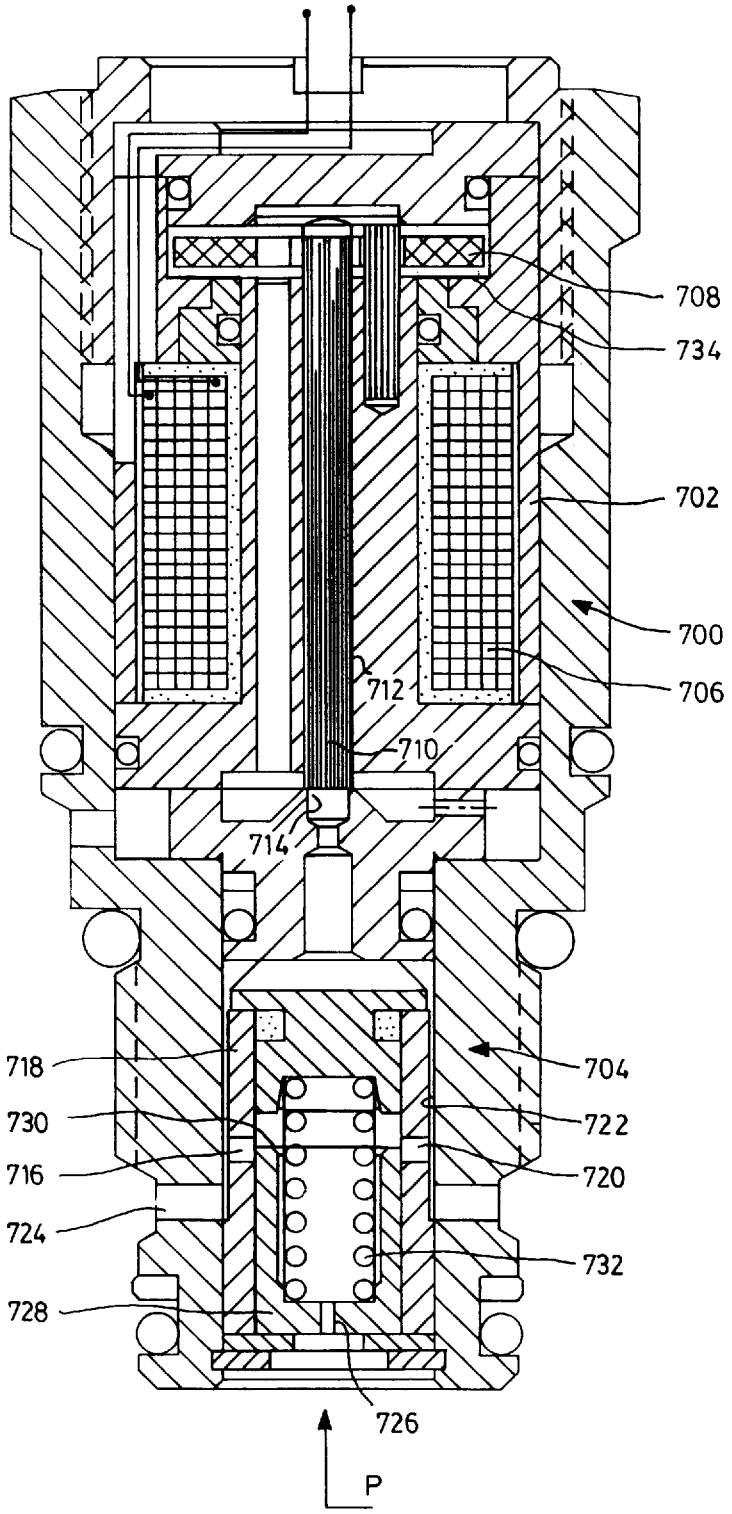
FIG. 22 is a sectional view through a valve as used in FIG. 20.

An embodiment of a preferred proportional pilot valve is shown in FIG. 22 and includes the body 700 housing an actuator 702 and a pilot stage 704. The actuator 702 is similar to that shown in FIG. 14 and includes a coil 706 that establishes a magnetic force upon a disk 708 proportional to the current supplied to the coil. The disk 708 is secured to a pin 710 that extends through a bore 712 to overlie a control orifice 714. The pin 710 is formed from aluminum having a hard surface coating formed from anodizing.

Fluid is delivered to the orifice 714 by a flow control assembly 716. The flow control assembly includes an outer sleeve 718 which is fixed relative to the body 702 and has a pair of radial passages 720. The outer sleeve 718 in located within a bore 722 with a clearance between the radially outer surface of the sleeve 718 and the bore 722 to allow fluid to flow to the control orifice 714 and to the control ports 724 provided in the body 702. Control port 724 is connected to respective one of the chambers 606.

Control fluid is supplied to the flow control assembly 716 through a restrictive orifice 726 located in a inner sleeve 728. The inner sleeve 728 is slidable within the outer sleeve 718 and has an upper control edge 730 overlying the radial passage 720. The overlap between the edge 730 and the passage 720 determines the cross sectional area of the flow control orifice. A spring 732 biases the sleeve 728 to a position in which the control orifice is a maximum.

In operation, the control flow is supplied to the orifice 726 and flows through the orifice into the interior of the sleeve 728. The flow is then discharged to across the orifice provided between the edge 730 and the passage 720 and is delivered to the control orifice 714 and the control ports 724 to control chamber 606.

Flow through the control orifice 714 is regulated by the spacing of the pin 710 from the control orifice 714 which in turn is determined by the force supplied by the coil 706 on the disk 708. The greater the force, the greater the pressure established in the control chamber 606. The inner and outer sleeves 728 and 718 respectively, provide a pressure compensation for the flow delivered to the controlling orifice 714. Thus the pressure delivered to the control chamber 606 may be modulated by the current supply to the coil 706.

The pin 710 is formed, as noted above from aluminum. Accordingly, as the temperature of the hydraulic fluid increases, there is a differential expansion between the body and the pin which adjusts the flow orifice defined between the pin 710 and the control orifice 714. Compensation for variations in viscosity are therefore provided so that the control pressures supplied to the chamber 606 are maintained. The object is to maintain the air gap between the disk 708 and the pole pieces associated with the coil 706 constant and thereby provide a constant force for a given current. Further compensation for temperature variations may be provided by adjustment of the control current through look-up tables in response to temperature sensing of the fluid if necessary.

As may be seen from FIG. 22, at non-magnetic shim 734 is included between the disk 708 and pole pieces to reduce the volume of the chamber in which the disk may move. This does not affect the air gap between the poles and the disk but does reduce the volume of fluid that is displaced as the disk 708 is moved in the chamber.

Referring once again to FIG. 20, the control spool 202*e* extends beyond the spacers 216*e* into each of the chambers 600 so that pressure in those chambers acts with opposite directions upon the spool 202*e*. An opposing bias for the spool 202*e* is provided by means of a spring plate 610 shown more fully in FIG. 21. Alternatively, a conventional coil spring may be provided at each end with provision for lost motion between the spool and spring in one direction of movement.

The plate 610 has an outer ring 612 which is trapped between the plugs 602 and spacers 216*e*. A pair of radial webs 614 connect the ring 612 to an intermediate ring 616 which in turn is connected by webs 618 to an inner ring 620. The webs 618 are disposed perpendicular to the webs 614 so that the intermediate ring 616 acts as a beam between the webs 614, 618 to provide resilience. The inner ring 620 has a central hole 622 that receives the spool 202*e* and abuts against a radial shoulder 624 on the spool 202*e*.

One end of spool 202*e* carries a magnetic insert 232*e* which co-operates with a Hall effect.

In operation, the control spool 202*e* is initially displaced by adjustment of the current to the valves 608 that establishes a pressure differential in the chambers 600. The pressure differential acts to move the spool 202*e* in one direction which is opposed by the resilience of the spring plate 616. Initial displacement of the spool 202*e* to the right as viewed in FIG. 20 causes the lands 208*e* to uncover the cross drilling 204 and allow pressure fluid to be supplied through the bypass passage 212*e* into the end chamber 214*e*. At the same time, the land 210*e* uncovers the connection to tank 206*e* at the opposite end of the spool 202*e* so that the opposite end chamber 214*e* is vented to tank through the respective bypass passage 212*e*. The pressure imbalance causes the spool 40*e* to be displaced to the right so that the groove 80*e* bridges the pressure port 16*e* and the supply port 20*e*. At the same time, the circumferential groove 84*e* bridges the tank port 24*e* and supply port 18*e* and allows flow to tank.

The initial displacement of the control spool 202*e* is monitored by the position sensor 234*e* so that it may be held in the desired position. the spool 40*e* follows the control spool 202*e* and will be hydraulically balanced when the spool is again centered on the control spool 202*e*. In this position, however, flow can still proceed from the pressure duct 16*e* and to tank duct 24*e*. Because the control spool 202*e* is not subject to the flow forces associated with the fluid flow, the loads on the spool 202*e* are reduced and the control pressures in the chambers 600 are not affects. Again, fluctuations in pressure may be sensed by the pressure transducer assembly 150*e* and fed through the controller 164*e* to modulate the valves 608 position of the control. It will also be noted that the flow forces acting between the control spool 202*e* and spool 40*e* are complementary to the direction of closing of the ports 204*e* which assists in response to the valve.

We claim:

1. A hydraulic valve having a body, a valve member movable within the body to control flow through a pair of ports in said body, an electromagnetic actuator operable upon said valve member and receiving electrical control signals from a controller to modulate the position of said valve member relative to said body, a transducer associated with said valve member to provide a feedback signal indicative of a predetermined parameter to said controller, said controller utilizing said feedback signal to modulate said electrical control signals to said actuator to maintain a hydraulic parameter at a predetermined value, said valve member including a first spool movable relative to said body to connect selectively said ports and having a first pair of chambers formed between said body and said first spool and located at opposite ends thereof, a control spool slidably mounted in said first spool and moveable relative thereto to control flow of fluid to said first pair of chambers, a second pair of chambers formed between said body and said control spool at opposite ends thereof, said actuator modulating pressure of fluid in respective ones of said second chambers to adjust the position of said control spool and thereby said first spool in response to variations in said feedback signal.

2. A hydraulic valve according to claim 1 wherein said transducer includes pressure transducer assembly to monitor a pressure differential between a pair of said ports and said feedback signal varies as said pressure differential varies.

3. A hydraulic valve according to claim 2 wherein said pressure transducer assembly monitors a pressure differential between a port receiving fluid from a source and a port supplying fluid to a consumer to provide an indication of flow rate across said valve member.

4. A hydraulic valve according to claim 3 wherein a position transducer is associated with one of said spools of said valve member and said controller correlates said feedback signal and position feedback signal to determine the flow rate across said valve member.

5. A hydraulic valve according to claim 4 wherein said controller includes a microprocessor having a lookup table providing flow rates at different positions of said valve member over a range of pressure differentials.

6. A hydraulic valve according to claim 2 wherein said pressure transducer assembly monitors a pressure differential between a port delivering fluid to a consumer and a port receiving fluid from said consumer, said pressure differential being indicative of a force exerted by said consumer.

7. A hydraulic valve according to claim 6 wherein said controller adjusts said electrical control signals to said actuator and adjusts said valve member to maintain said pressure differential at a predetermined value.

8. A hydraulic valve according to claim 7 wherein a position transducer is associated with one of said spools of said valve member to provide a position feedback signal and said position feedback signal overrides said feedback signal obtained from said pressure transducer assembly to limit movement of said valve member.

9. A hydraulic valve according to claim 1 wherein said actuator includes a coil and an armature operable upon said valve member and said controller varies the magnitude of current supplied to said coil.

10. A hydraulic valve according to claim 9 wherein movement of said armature adjusts a pilot pressure acting on said valve member to maintain it in a predetermined position.

11. A hydraulic valve according to claim 10 wherein said pilot pressure is modulated by adjusting a pilot flow through an orifice, said armature acting upon an operating member to adjust said pilot flow.

12. A hydraulic valve according to claim 10 wherein said valve member has a pair of oppositely directed pilot pressures acting thereon and said armature is operable to establish a pressure differential therebetween.

13. A hydraulic valve according to claim 12 wherein movement of said armature adjusts pilot flow through a pair of control orifices in a complementary manner to establish a pressure differential.

14. A hydraulic valve according to claim 12 wherein movement of said armature vents one of said pilot pressures to establish a pressure differential.

15. A hydraulic valve according to claim 14 wherein movement of said armature to vent one of said pilot pressures connects another of said pilot pressures to a pressure source.

16. A hydraulic valve according to claim 9 wherein said actuator includes a pair of radially spaced pole pieces and said armature extends radially across said pole pieces.

17. A hydraulic valve according to claim 16 wherein said armature is connected to an operating member to adjust a pilot pressure acting upon said valve member to control the position thereof.

18. A hydraulic valve according to claim 17 wherein said operating member regulates flow through a control orifice to adjust the pilot pressure acting upon said valve member.

19. A hydraulic valve according to claim 16 wherein a pair of actuators act upon said valve member each having a coil and an armature and said controller adjusts the current supplied to each coil in a complementary manner to control the movement of said valve member.

20. A hydraulic valve according to claim 1 wherein said valve member is slidably supported in a sleeve located within said body, said sleeve being formed by a plurality of rings arranged end to end and having respective axial dimensions corresponding to the axial extent of lands formed on said valve member.

21. A hydraulic valve according to claim 20 wherein said rings are formed of carbide.

22. A hydraulic valve according to claim 1 wherein said control spool directs flow to respective ones of said first chambers to cause movement of said first spool in the same direction as said control spool.

23. A hydraulic valve according to claim 22 wherein said first spool controls flow between an inlet port connected to a source of pressurized fluid and an outlet port for connection to a consumer, said first spool being closed centered to inhibit flow between said inlet and outlet ports when in a neutral position, and wherein said control spool controls flow between said inlet port and respective ones of said first chambers, said control spool being closed centered to inhibit flow between said first chambers and inlet when in a neutral position, whereby movement of said control spool from said neutral position connects said inlet to one of said first chambers and thereby displaces said first spool to connect said inlet port and outlet port.

24. A hydraulic valve according to claim 22 wherein said displacement of said first spool returns said control spool to a neutral position while maintaining a connection between said inlet port and outlet port.

* * * * *